US005758827A

United States Patent [19]

Van Le et al.

[11] Patent Number: 5,758,827

[45] Date of Patent: Jun. 2, 1998

[54] ROTARY SPRINKLER WITH INTERMITTENT MOTION

[75] Inventors: Tuan Van Le, Diamond Bar; Jack Thai Nguyen, Ontario, both of Calif.; Myrl Saarem, Carson City, Nev.

[73] Assignee: The Toro Company, Riverside, Calif.

[21] Appl. No.: 543,419

[22] Filed: Oct. 16, 1995

[51] Int. Cl.[6] ..... B05B 3/16

[52] U.S. Cl. ..... 239/242

[58] Field of Search ..... 239/236, 237, 239/240, 242, 251, 255, 259, 261, 263, 263.3, 241

[56] References Cited

U.S. PATENT DOCUMENTS

| | | |
|---|---|---|
| 3,645,451 | 2/1972 | Hauser . |
| 3,716,192 | 2/1973 | Hunter . |
| 3,924,809 | 12/1975 | Troup . |
| 3,955,764 | 5/1976 | Phaup . |
| 4,091,997 | 5/1978 | Ridgway . |
| 4,272,024 | 6/1981 | Kah, Jr. . |
| 4,417,691 | 11/1983 | Lockwood . |
| 4,434,937 | 3/1984 | Pitchford . |
| 4,537,356 | 8/1985 | Lawson . |
| 4,568,024 | 2/1986 | Hunter . |
| 4,595,141 | 6/1986 | Cherundolo et al. . |
| 4,650,118 | 3/1987 | Saarem et al. . |
| 4,681,259 | 7/1987 | Troup et al. . |
| 4,840,312 | 6/1989 | Tyler . |
| 4,867,378 | 9/1989 | Kah, Jr. . |
| 4,901,924 | 2/1990 | Kah, Jr. . |
| 4,948,052 | 8/1990 | Hunter . |
| 4,955,542 | 9/1990 | Kah, Jr. . |
| 4,972,993 | 11/1990 | Van Leeuwen . |
| 5,086,977 | 2/1992 | Kah, Jr. . |
| 5,104,045 | 4/1992 | Kah, Jr. . |
| 5,115,977 | 5/1992 | Alkalay et al. . |
| 5,141,157 | 8/1992 | Han et al. . |
| 5,299,742 | 4/1994 | Han . |

OTHER PUBLICATIONS

Chironis, Nicholas P., "Mechanisms & Mechanical Devices Sourcebook", copyright 1991, p. 86.

*Primary Examiner*—Andres Kashnikow
*Assistant Examiner*—Steven J. Ganey
*Attorney, Agent, or Firm*—Richard L. Myers

[57] ABSTRACT

A rotary sprinkler having an intermittent motion mechanism which includes a driving gear and a driven gear with the driving and driven gears being drivingly engageable. The driven gear has a first set of gear teeth on one level and a second set of gear teeth on a second level. The gear teeth of the first set are axially and circumferentially offset from the gear teeth of the second set. The driving gear has a single driving gear tooth drivingly engageable with the gear teeth of the first set to drive the driven gear and a circumferential surface axially offset from the driving gear tooth and cooperable with the gear teeth of the second set to substantially retain the driven gear against rotation when the driving gear tooth is not in driving engagement with the gear teeth of the first set.

13 Claims, 13 Drawing Sheets

ROTARY SPRINKLER WITH INTERMITTENT MOTION

BACKGROUND OF THE INVENTION

A rotary sprinkler typically includes a sprinkler head mounted for rotational movement on suitable supporting structure, a drive motor driven by the irrigation water, and a drive train having a rotational output and drivingly coupled to the motor and to the sprinkler head so that the rotational output can impart rotational movement to the sprinkler head. The sprinkler head rotates through a desired arc in both clockwise and counterclockwise directions, and the rotary sprinkler may also include a suitable mechanism for causing periodic pauses in the rotation of the sprinkler head such that the sprinkler head rotates intermittently.

Various mechanisms such as a piston drive, a four bar linkage drive and an impact drive have been used to provide intermittent motion to the sprinkler head. Also, Lockwood U.S. Pat. No. 4,417,691 discloses a Geneva wheel assembly for use in imparting intermittent motion to a sprinkler head.

SUMMARY OF THE INVENTION

This invention provides an intermittent motion mechanism for a rotary sprinkler which includes a driving gear and a driven gear with the driving and driven gears being drivingly engageable. Unlike the Geneva wheel mechanism, which utilizes a pin which slides in a slot, gears tend to have essentially rolling contact and consequently less friction and wear. The gear teeth on the driving and driven gears are generally relatively easy to make and assembly is facilitated.

The intermittent motion mechanism may be included in a rotary sprinkler which comprises a supporting structure having an inlet for receiving irrigation water, a sprinkler head mounted for rotational movement on the supporting structure and adapted to receive water from the inlet, a drive motor carried by the supporting structure and a drive train having a rotational output and being drivingly coupled to the motor and to the sprinkler head so that the rotational output can impart rotational movement to the sprinkler head.

The rotary sprinkler may also be capable of reversing the direction of the rotational output of the drive train and hence of the sprinkler head. For example, this may be accomplished by reversing the drive motor or by a reversing mechanism or shifter. In this event, the intermittent motion mechanism preferably causes a pause in the rotational output in each direction of the rotational output.

The driving gear preferably has a driving gear tooth on one level and first and second circumferentially spaced gear tooth surfaces on a second level with the driving gear tooth being between the gear tooth surfaces and axially offset from the gear tooth surfaces. The driven gear is cooperable with the driving gear tooth and the first gear tooth surface to be driven in one direction and with the driving gear tooth and the second gear tooth surface to be driven in the other direction.

In a preferred implementation, the driven gear has a first set of gear teeth on one level and a second set of gear teeth on a second level with the gear teeth of the first set being axially and circumferentially offset from the gear teeth of the second set. The driving gear tooth is drivingly engageable with the gear teeth of the first set and the gear tooth surfaces are drivingly engageable with the gear teeth of the second set to drive the driven gear. The driving gear has a circumferential surface axially offset from the driving gear tooth and cooperable with the gear teeth of the second set to substantially retain the driven gear against rotation when the driving gear tooth is not in driving engagement with the gear teeth of the first and second sets of gear teeth. Although the driving gear may have a plurality of driving gear teeth, preferably it has only a single driving gear tooth on said one level which is drivingly engageable with the driven gear.

In a preferred construction, adjacent gear teeth of each of the first and second sets are spaced circumferentially by an amount sufficient to accommodate another gear tooth and two tooth spaces with such gear tooth and tooth spaces being of size to cooperate with the driving gear tooth. With this construction, alternate teeth from each of the sets of gear teeth are missing such that adjacent teeth are spaced apart not merely by a single tooth space, but rather by two tooth spaces and the width of a gear tooth.

Viewed from a different perspective, the preferred intermittent motion mechanism is a form of multilated tooth intermittent drive. However, the intermittent motion mechanism of this invention differs from a conventional multilated tooth intermittent drive in that it can be driven and transmit motion in both clockwise and counterclockwise directions and is therefore adapted for use in a rotary sprinkler which rotates in both directions.

The invention, together with additional features and advantages thereof may best be understood by reference to the following description taken in connection with the accompanying illustrative drawings.

BRIEF DESCRIPTION OF THE DRAWINGS

FIG. 15 is a sectional view similar to FIG. 14 taken on a plane perpendicular to the plane on which FIG. 14 is taken.

DESCRIPTION OF THE PREFERRED EMBODIMENT

Figure 1:
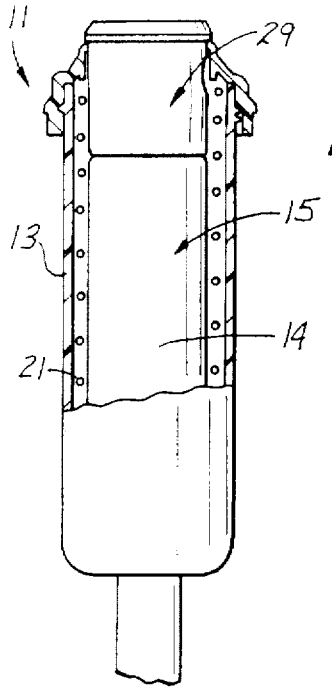
FIG. 1 is an elevational view partially in section of a rotary sprinkler constructed in accordance with the teachings of this invention with the riser in the lower position.
Figure 2:
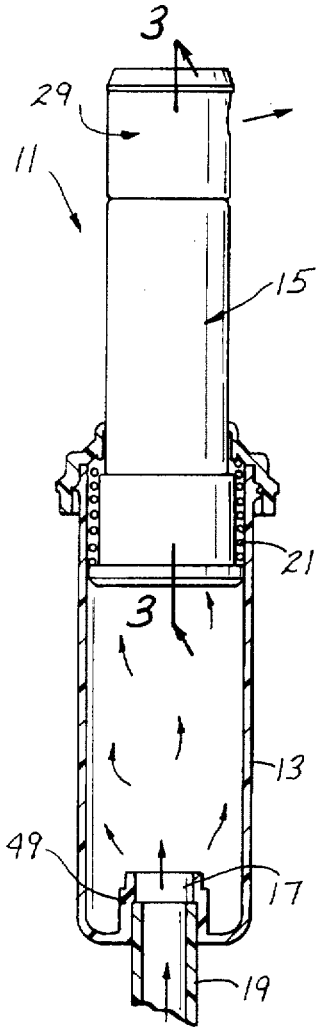
FIG. 2 is an axial sectional view similar to FIG. 1 with the riser in the upper position.

FIGS. 1 and 2 show a rotary sprinkler 11 having a supporting structure which includes a case 13 and a housing 14 of a riser 15. The case 13 has an inlet 17 (FIG. 2) for receiving irrigation water from a conduit 19 to which the case is attached. The riser 15 is normally held in the lower position of FIG. 1 by a coil spring 21 and can be moved to the upper position or popped-up in response to water pressure from the conduit 19 acting to lift the riser 15 against the biasing action of the spring 21.

Figure 3:
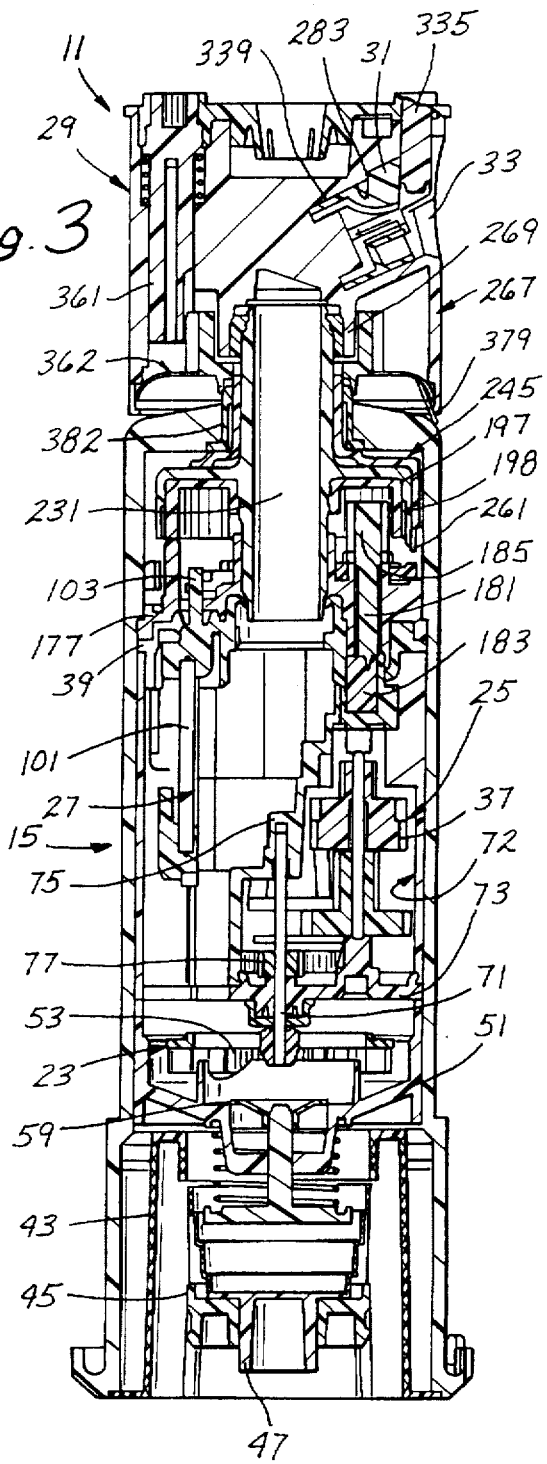
FIG. 3 is an axial sectional view through the riser.

With reference to FIG. 3, the sprinkler 11 generally includes a unidirectional drive motor in the form of a water driven turbine 23 mounted for rotation within the riser 15, a drive train 25 drivingly coupled to and driven by the turbine 23, an overcenter spring device 27 and a spray head or sprinkler head 29 including a nozzle 31 defining an outlet 33 mounted for rotational movement and adapted to receive irrigation water from the inlet 17 (FIG. 2). Thus, the turbine 23 drives the drive train 25 to rotate the sprinkler head 29.

Figure 4:
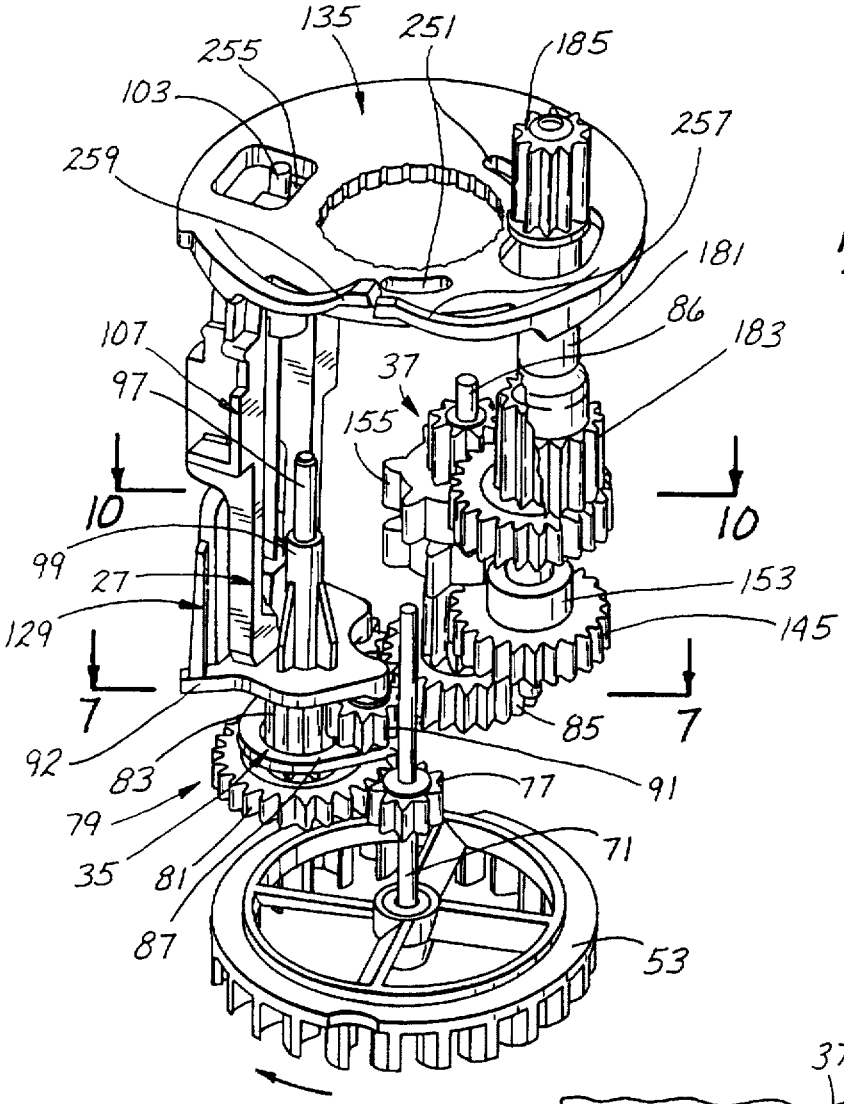
FIG. 4 is a perspective view with parts removed illustrating the turbine and portions of the drive train including the shifter and intermittent motion mechanism.
Figures 6, 6A, 6B, 6C:
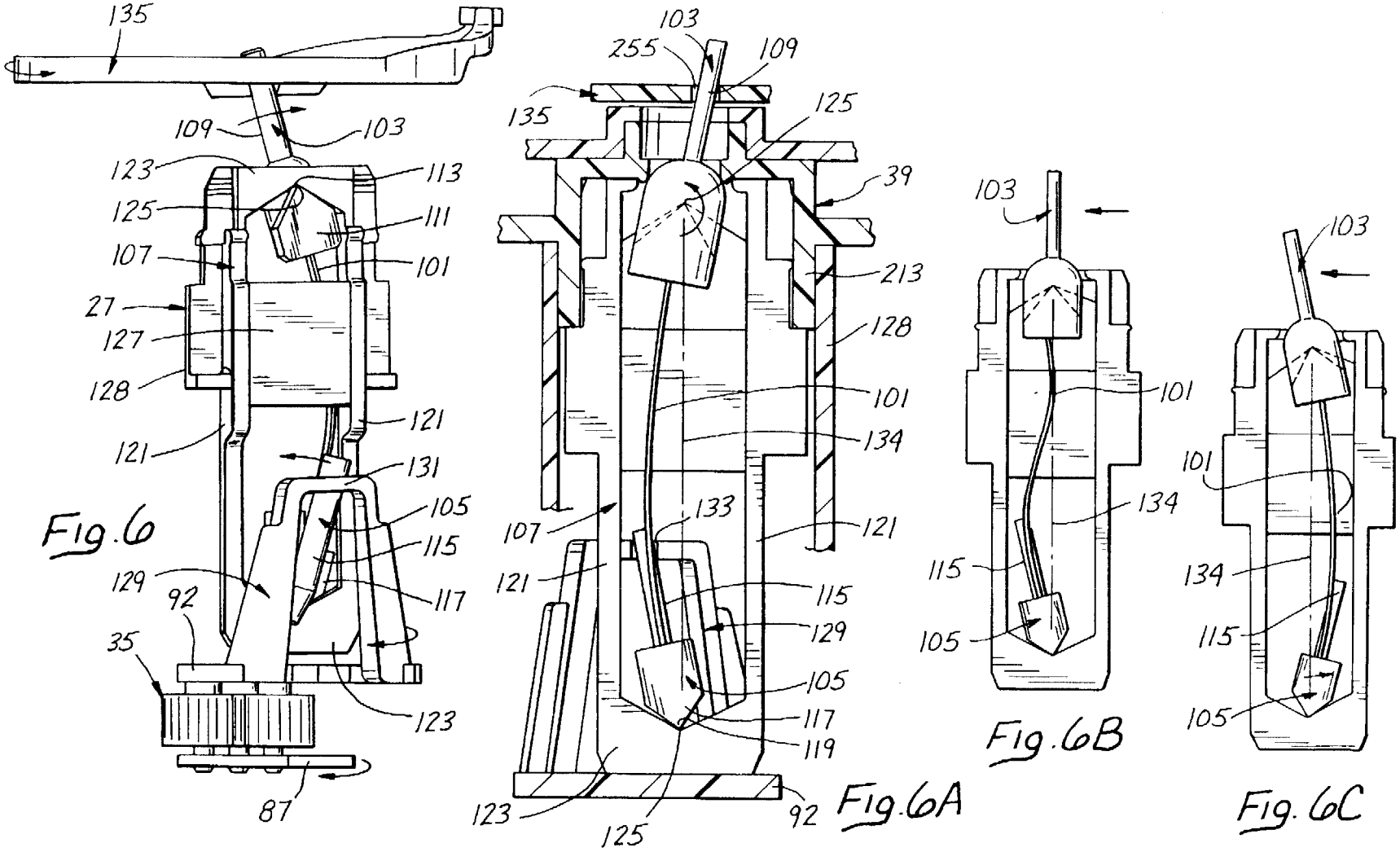
FIG. 6 is a front elevational view of a preferred form of overcenter spring device.
FIG. 6A is a rear elevational view of the overcenter spring device with the spring element in the same position as in FIG. 6 and showing some of the supporting structure for the overcenter spring device.
FIGS. 6B and 6C are simplified views similar to FIG. 6A illustrating operation of the overcenter spring device.
Figure 9:
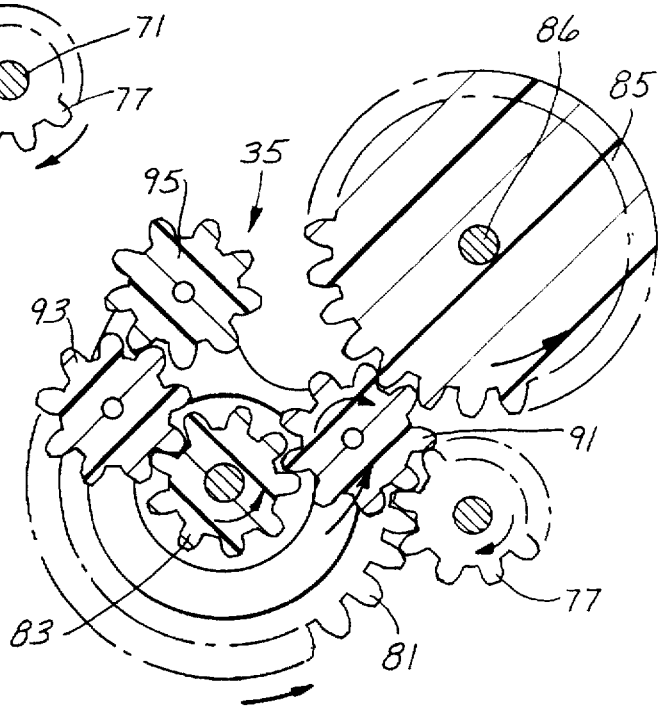
FIG. 9 is a view similar to FIG. 7 illustrating movement of the shifter to the other position to reverse the direction of the rotational output.
Figure 10:
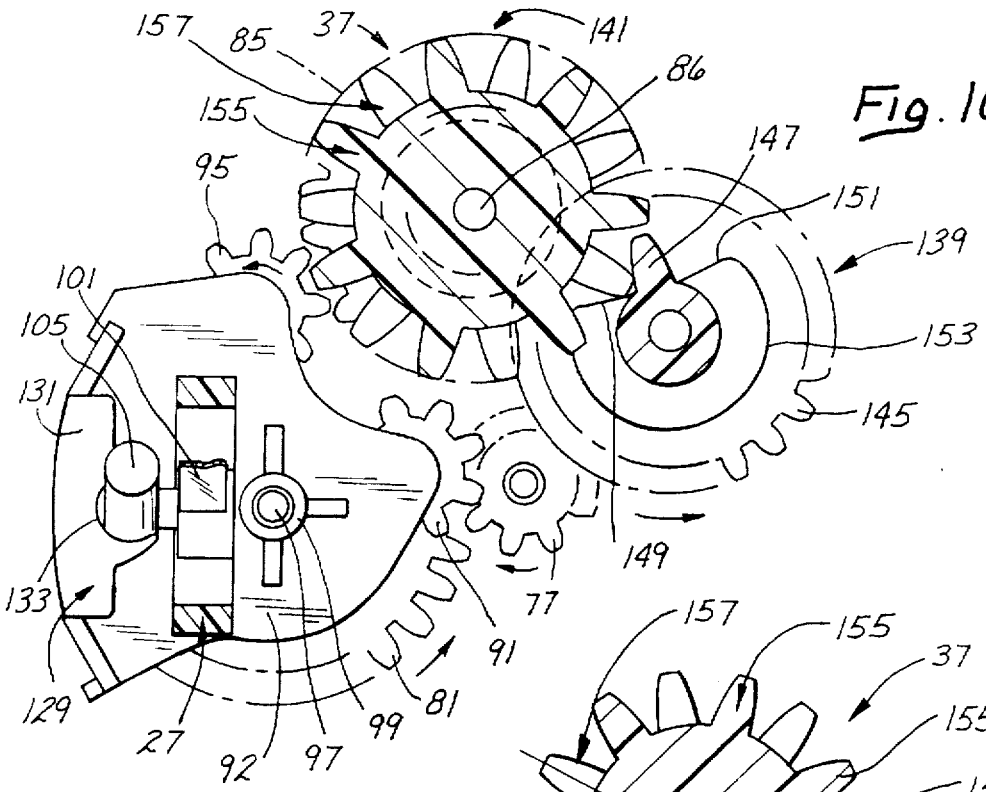
FIG. 10 is a plan view partially in section illustrating the overcenter spring device and a preferred form of intermittent motion mechanism.

To enable the sprinkler head 29 to be rotated in both the clockwise and counterclockwise directions, the drive train 25 includes a shifter or reversing device or reversing mechanism 35 (FIGS. 4, 6, 7 and 9) which is drivingly coupled to the overcenter spring device 27 (FIG. 4, 6, and 10). To cause the sprinkler head 29 to rotate intermittently or to have pauses in its rotation, the drive train 25 includes an intermittent motion mechanism 37 (FIGS. 3, 4, 10 and 11).

Figure 12:
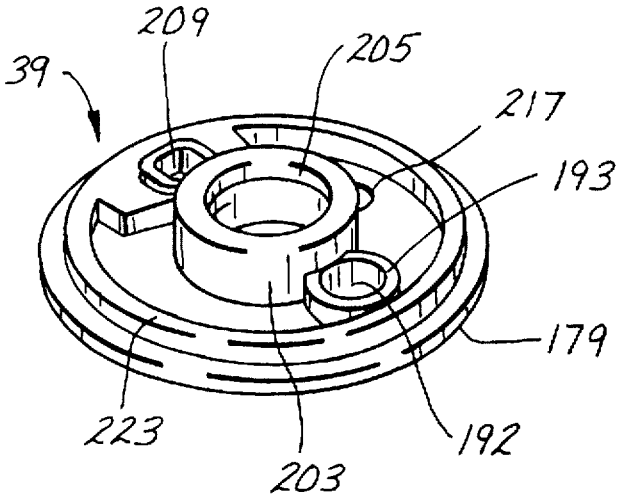
FIGS. 12 and 13 are perspective views of the adapter seal.
Figure 13:
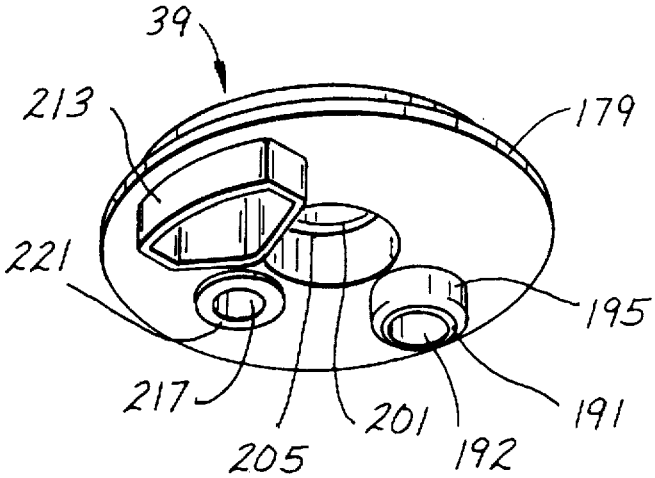

The sprinkler 11 also includes an adapter seal 39 (FIGS. 3, 12 and 13) which performs various sealing and mounting functions.

The Inlet and Turbine Section

Figure 3B:
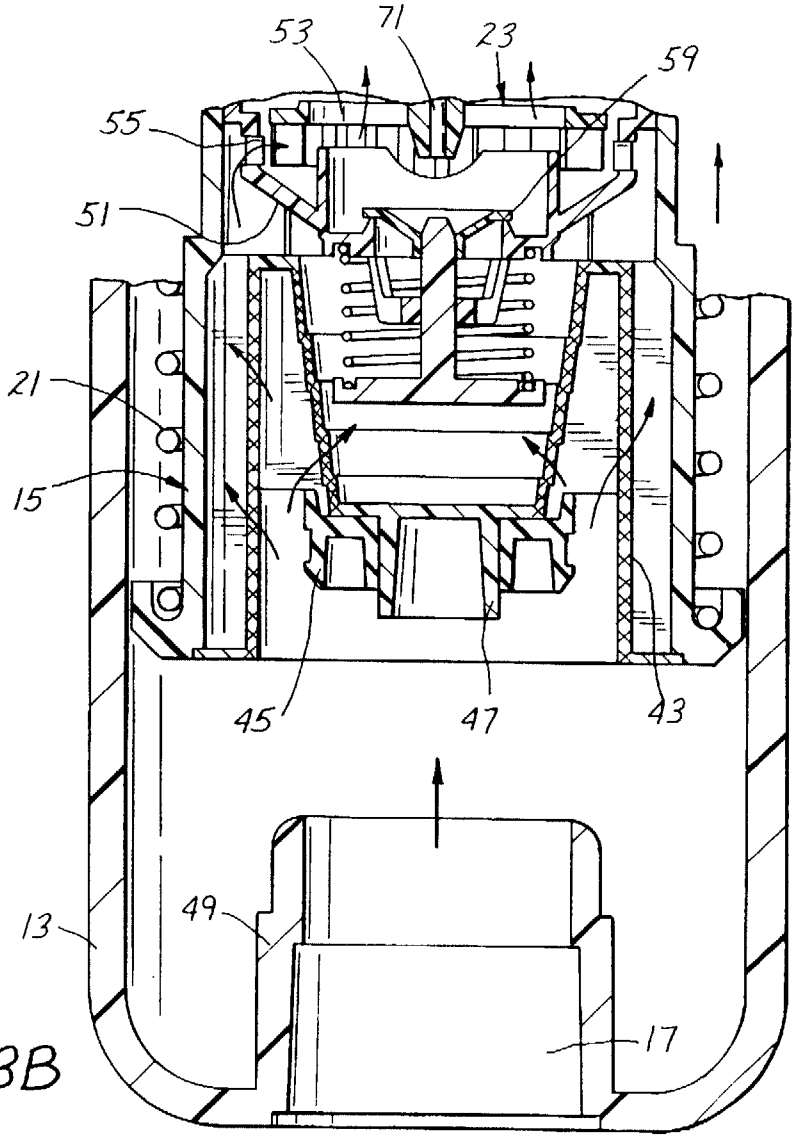
FIGS. 3A and FIG. 3B are enlarged, fragmentary, axial sectional views through the inlet and turbine section taken on a plane generally perpendicular to the plane of FIG. 3 showing the riser in the lower and upper positions, respectively.
Figure 3A:
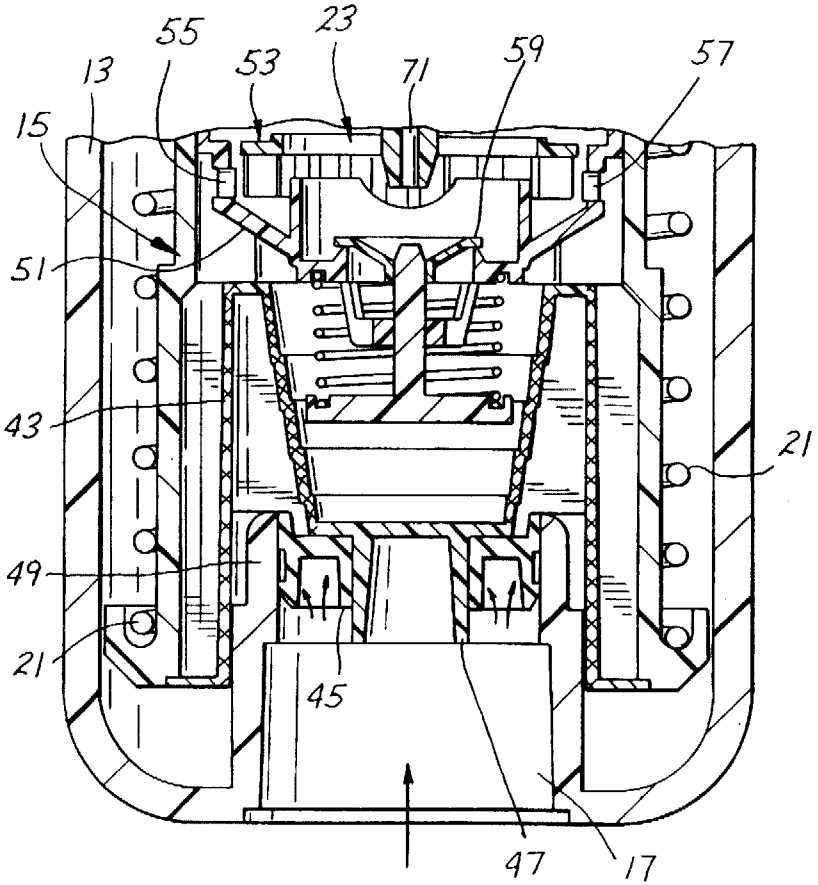

The inlet and turbine section may be considered as that portion of the sprinkler 11 from the turbine 23 (FIGS. 3, 3A, and 3B) down through the inlet 17 (FIGS. 2, 3A and 3B). The inlet and turbine section may be generally of conventional construction. In the form shown in FIGS. 3, 3A and 3B, a tubular filter screen 43 is suitably affixed to the riser 15 at the lower end of the riser. An annular resilient seal 45 is mounted on a depending boss 47 of the filter screen 43 and is received within the inlet 17 when the riser 15 is in the lower position. Specifically, the seal 45 sealingly engages a sleeve portion 49 of the case 13 and cooperates with the sleeve portion to form a valve which prevents water under pressure from the conduit 19 (FIG. 2) from passing through the inlet 17 into the riser 15 when the riser is in the lower position of FIG. 3A.

When water under pressure is supplied to the inlet 17, it acts against the seal 45 to force the riser 15 upwardly against the biasing action of the spring 21 to the upper position of FIG. 3B. This allows the water under pressure to pass through the filter screen to the turbine 23.

The turbine 23 comprises a rotor 53 and a stator 51 suitably fixedly mounted within the riser 15. The stator has openings 55 and 57 through which water can flow to drive the rotor 53 in a conventional manner. A conventional spring biased bypass valve 59 opens in response to predetermined pressure differential across the turbine to limit the pressure drop across the turbine 23 to a predetermined maximum to maintain a predetermined rotor speed.

The rotor 53 is mounted for rotation on an axially extending turbine shaft 71 (FIGS. 3, 4 and 4A) which in turn is suitably rotatably mounted on an inner housing 72 (FIGS. 3, 3C and 4A) which is suitably mounted within the riser 15 and which forms a portion of the supporting structure. The inner housing 72 includes a transverse plate or wall 73, which rests on the upper end of the stator 51 and mounts the lower end of the shaft 71, and a stepped wall 75 which forms a bearing for the upper end of the shaft 71. Consequently, rotation of the rotor 53 rotates the shaft 71 to provide the output for the turbine 23. The inner housing 72 serves as an unsealed gear box which water can enter to lubricate the gears contained within it. The inner housing 72 also provides a flow path 76 (FIG. 3C) leading from just above the rotor 53 to the adapter seal 39.

Figure 3C:
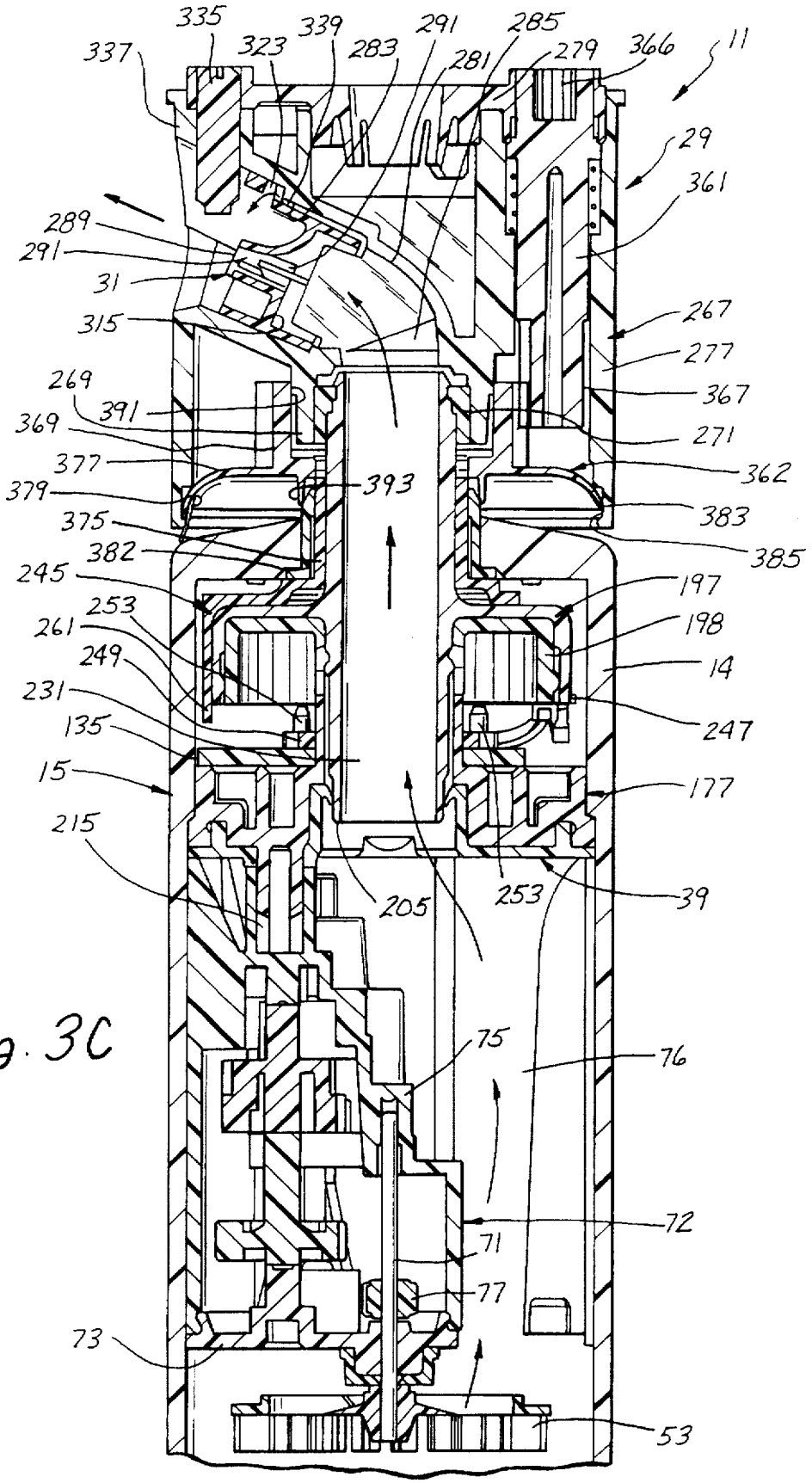
FIG. 3C is a fragmentary, axial sectional view similar to FIG. 3 with portions removed and taken on a different axial plane.
Figure 4A:
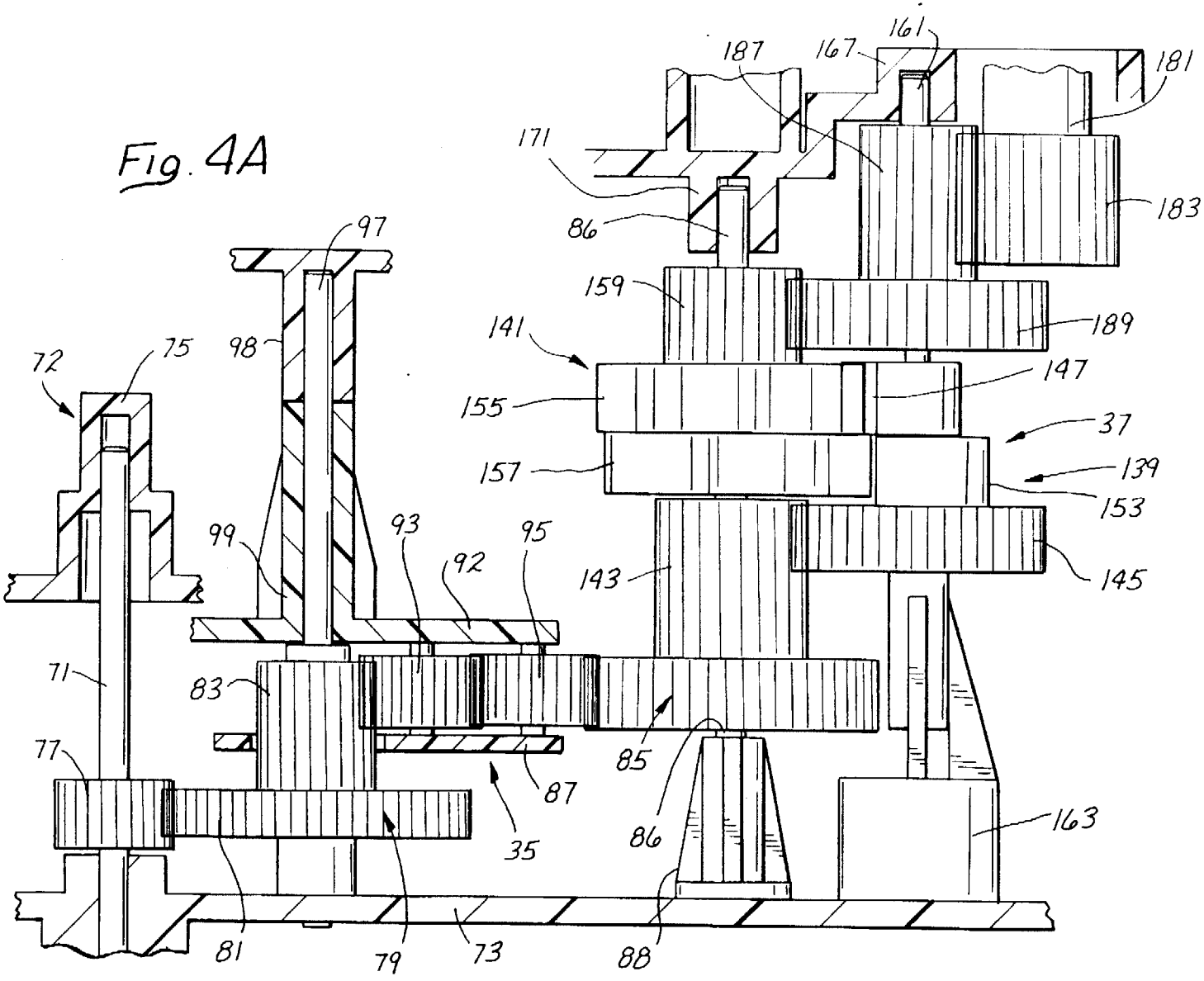
FIG. 4A is a somewhat schematic view of the gears from the turbine shaft through the intermittent motion mechanism to the output shaft.
Figure 7:
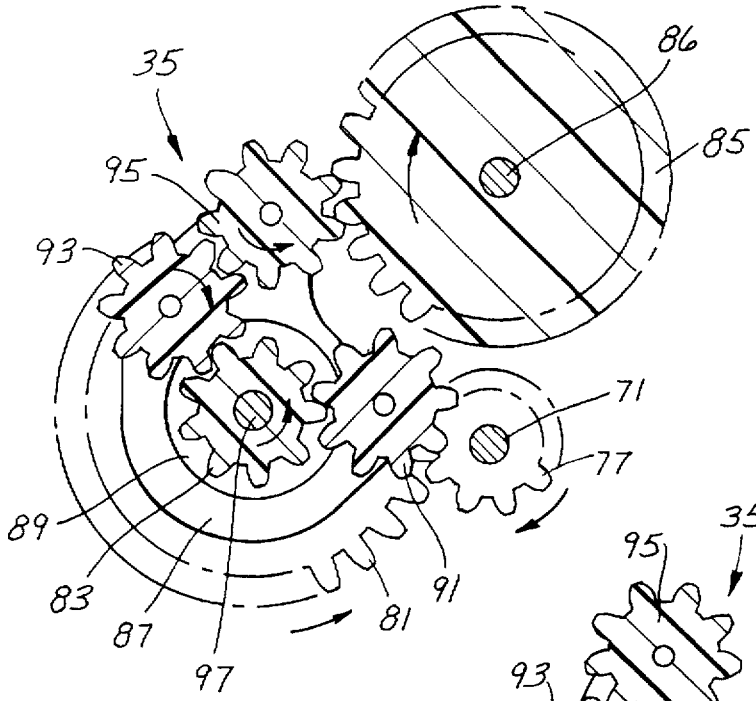
FIG. 7 is a plan view partially in section illustrating one embodiment of shifter.

The Drive Train 25 and the Mechanism or Device to Reverse Its Rotational Output A pinion 77 (FIGS. 3C, 4 and 4A) is mounted on and rotates with the shaft 71 and drives a double or speed reducing gear 79 along a lower and larger gear section 81 (FIG. 4A) of the double gear. The double gear 79 has a smaller or upper gear section or driving gear 83 (FIGS. 4, 4A and 7). These gears, like many of the other gears described below, provide a speed reduction function.

The shifter 35 is drivable between the position shown in FIG. 7 in which it drives a driven gear 85 clockwise and the position shown in FIG. 9 in which it drives the driven gear 85 counterclockwise. The driven gear 85 is mounted for rotation on a shaft 86. The shaft 86 is received in a bearing 88 (FIG. 4A) on the transverse plate 73 and the gear 85 can rest on the bearing 88.

In this embodiment, the shifter 35 includes a mounting plate 87 having an opening 89 through which the gear section 83 extends and two groups of gears both of which are driven by the gear section 83. The first group of gears comprises a single gear 91 rotatably mounted between the mounting plate 87 and an actuating plate 92 (FIGS. 4, 4A and 6), which also forms a part of the shifter 35. The second group of gears includes gears 93 and 95, and they are also rotatably mounted between the mounting plate 87 and the actuating plate 92. The gears 91, 93 and 95 are rotatably mounted by pins which also serve to join the mounting plate 87 to the actuating plate 92 such that the entire shifter, which comprises these two plates and the three gears form a unitary sub-assembly. The driving gear 83 drives both groups of gears; however, the arrangement is such that either the gear 91 or the gear 95 is in driving engagement with the driven gear 85. Because the gears 91 and 95 counter rotate, with the driving gear 83 rotating counterclockwise as shown in FIG. 7, the gear 95 drives the driven gear 85 clockwise, and with the shifter in the position of FIG. 9, the gear 91 drives the driven gear 85 counterclockwise.

The double gear 79 is mounted for rotation on a shaft 97 which in turn is mounted by the transverse wall 73 and a bearing 98 (FIG. 4A) which forms a portion of the inner housing 72. A sleeve 99 on the actuating plate 92 mounts the shifter 35 for pivotal movement about the shaft 97 between the positions of FIGS. 7 and 9.

The overcenter spring device 27 is drivingly coupled to the shifter 35 for driving the shifter between the positions of FIG. 7 and 9 to thereby reverse the direction of the driven gear 85 and the direction of the rotational output of the drive train. Generally the overcenter spring device 27 includes an elongated spring element 101 (FIG. 6 and 6A), an input pivot member 103 and an output pivot member 105 coupled to opposite end portions of the spring element and a spring retainer 107 for use in pivotally mounting the input and output pivot members and for holding the spring element in a bowed configuration. The spring element 101, which may be constructed of spring steel, is in the form of a flat, linear member when unrestrained. The input pivot member 103, which may be constructed of a suitable rigid polymeric material, includes an input lever 109 having a shoulder 111 with a sharp pivot edge 113 (FIG. 6). Similarly, the output pivot member 105 includes an output lever 115 and a shoulder 117 with a pivot edge 119 (FIG. 6A).

The retainer 107 is in the form of an elongated frame which includes spaced parallel longitudinal members 121 and transversely extending fulcrum members 123. Each of the fulcrum members 123 has a shallow V-shaped notch with the apex of the V forming a fulcrum 125. The edges 113 and 119 are received in the V-shaped notches and engage the fulcrums 125, respectively, such that the pivot members 103 and 105 can pivot about the associated fulcrum. A plate 127 extends between and is attached to the longitudinal members 121 intermediate the fulcrums 125 to make the retainer more rigid. The retainer 107 is held stationary in the inner housing 72 by walls 128 on the inner housing 72 and by the adapter seal 39.

A driver 129, which in this embodiment is in the form of an inverted U-shaped member integral with the actuating plate 92, has a web 131 integrally joining two upstanding legs of the driver. The web has a recess 133 (FIGS. 6A and 10) which slidably receives an upper region of the output lever 115 to provide a driving connection between the output lever and the driver 129. The driver 129 may be considered as part of the shifter 35 or the overcenter spring device 27.

In the position shown in FIG. 6A, the spring element 101 is bowed in one direction on one side of a reference line or centerline 134, i.e. a line extending directly between the fulcrums 125. In this position, the resilience of the spring holds the edges 113 and 119 against the associated fulcrums 125. As explained more fully below, a rotatable plate 135 (FIGS. 6 and 6A) is driven by the drive train 25 and in turn pivots the input lever. By pivoting the input lever 109 counterclockwise about the fulcrum 125 as viewed in FIG. 6A, the input lever moves in a direction which is generally transverse to the direction of elongation of the spring element 101.

This drives the spring element 101 toward the centerline and causes it to buckle into the compound curve shown by way of example in the neutral position of FIG. 6B.

Further counterclockwise pivotal movement of the input lever 109 moves the spring element 101 over the centerline to reverse the direction in which the spring element is bowed as shown in FIG. 6C. Thus, the spring element 101 serves as a buckling column spring. In moving overcenter, the spring element 101 pivots the output lever 115 about its fulcrum 125 to the position shown in FIG. 6C. Because the retainer 107 is held against movement in the inner housing 72, the clockwise pivotal movement of the output lever 115 (FIGS. 6A-6C) forces the driver 129, the plate 92 and the entire shifter 35 to pivot about the shaft 97 from the position of FIG. 9 to the position of FIG. 7 to thereby reverse the direction of rotation of the driven gear 85.

It is apparent that a relatively short input motion imparted to the input lever 109 is sufficient to buckle the spring element 101 and move it overcenter. Accordingly, the work required to achieve reversal is minimized.

The gears 85, 91 and 95 are inherently forced into tighter driving engagement by virtue of the torque transmitted by these gears, and this tends to resist disengagement of the gears 85 and 95 and 85 and 91. This in turn requires more force from the spring element 101 in order to achieve the disengagement and ultimate reversal of the rotational output. However, this invention employs the intermittent motion mechanism 37 which creates intermittent pauses in the rotational output of the drive train 25. An advantage of the intermittent motion mechanism 37 is that during a pause the force urging the gears 91 and 95 into engagement with the gear 85 by virtue of their rotation is reduced. Consequently, if during a pause the spring element 101 is only slightly over center, it can provide sufficient energy to reverse the direction of rotation thereby minimizing the energy required for shifting.

It should also be noted that the sprinkler 11 is elongated and that the elongated spring element 101 extends generally longitudinally of the sprinkler. This enables the spring element 101 to be relatively long so it can provide greater force for the reversal and also facilitates locating of the shifter 35 relatively near the turbine 23, i.e. low down in the drive train 25, where torque is less and consequently the force tending to hold the gears 91 and 95 in engagement with the gear 85 is correspondingly less. Because this latter force is reduced, disengagement of the engaged gears of the shifter is made easier.

The Intermittent Motion Mechanism 37

Figure 11:
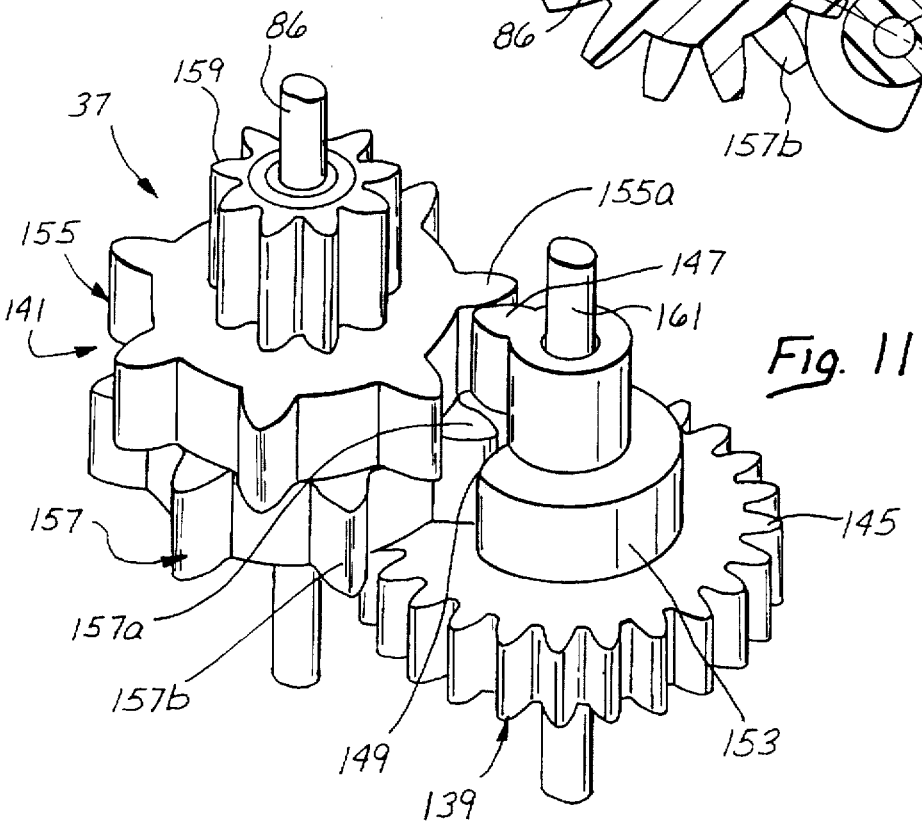
FIG. 11 is a perspective view of the intermittent motion mechanism.

The intermittent motion mechanism 37 (FIGS. 4A and 11) generally comprises a driving gear 139 and a driven gear 141 which are drivingly engageable to create periodic pauses in the rotation of the driven gear 141. The intermittent motion mechanism 37 as shown in FIG. 11 is in the form of a multilated tooth intermittent drive which is capable of being driven and of transmitting motion in both the clockwise and counterclockwise directions.

The driving gear 139 is itself suitably driven by the driven gear 85 (FIGS. 4A, 7, 9 and 10). In this embodiment, the driven gear 85 drives the driving gear 139 of the intermittent motion mechanism 37 through speed reducing gears which include a small diameter upper gear section 143 of the driven gear 85 (FIGS. 4 and 4A) which drives a larger diameter gear 145 (FIGS. 4, 10 and 11), the latter being an integral part of the driving gear 139. The driving gear 139 has a single driving gear tooth 147 on an upper level and circumferentially spaced gear tooth surfaces, 149 and 151 on a lower level. The driving gear tooth 147 is equally spaced circumferentially between the gear tooth surfaces 149 and 151 and is axially offset from these surfaces. The driving gear 139 also has a circumferential surface 153, which is preferably circular, and which is on the lower level and therefore axially offset from the driving gear tooth 147. The driving gear tooth 147 is an involute tooth and the gear tooth surfaces 149 and 151 are involute gear tooth surfaces. Each of the gear tooth surfaces 149 and 151 forms, in effect, one half of an involute gear tooth.

The driven gear 141 has a first set of involute gear teeth 155 on an upper level or gear section and a second set of involute gear teeth 157 on a lower level or gear section with the gear teeth of the first set being both axially and circumferentially offset from the gear teeth of the second set. The gear teeth of each of the first and second sets are spaced circumferentially by an amount sufficient to accommodate another gear tooth of the same size as the gear teeth of such set and two tooth spaces. Such another additional gear tooth and such tooth spaces are of a size to cooperate with the driving gear tooth 147. As shown in FIG. 11, the teeth of the first set of gear teeth 155 are centered between an adjacent pair of teeth of the second set 157. Output from the intermittent motion mechanism 37 is derived from a small gear section 159 which is above the set 155 of gear teeth. Both the driving gear 139 and the driven gear 141 are of integral, one-piece construction.

The driving gear 139 is mounted for rotation about a shaft 161 which is mounted at its lower end by a bearing 163 (FIG. 4A) mounted on the transverse plate 73 and at its upper end by a bearing section 167 suitably formed on the inner housing 72. The driving gear 139 rests on the top of the bearing 163. The driven gear 141 is rotatably mounted on the shaft 86, and the upper end of this shaft is received within a bearing section 171 of the inner housing 72. The driven gear 141 rests on the gear section 143.

In use, the driving gear 139 is rotated and the driving gear tooth 147 is drivingly engageable with the gear teeth of the first set of gear teeth 155 and the gear tooth surfaces 149 and 151 are drivingly engageable with the gear teeth of the second set of gear teeth 157 to drive the driven gear 141. More specifically and as shown in FIG. 11, the driving gear tooth 147 engages a gear tooth **155*a* of the first set 155 to impart an initial increment of rotation to the driven gear 141. As the driving gear tooth 147 passes out of driving contact with the tooth 155*a*, the gear tooth surface 149 engages a gear tooth 157*a* of the second set 157 to impart a second increment of angular movement to the driven gear 141. While the driving gear tooth 147 is driving the tooth 155*a*, the space between the gear tooth surfaces 149 and 151 accommodates or receives the gear tooth 157*a* so that there is no interference between the driving gear 139 and the driven gear 141. After the gear tooth surface 149 passes out of driving engagement with the gear tooth 157*a*, the circumferential surface 153 comes between and cooperates with the gear teeth 157*a* and 157*b* of the second or lower set of gear teeth as shown in FIG. 1OA to substantially retain the driven gear 141 against rotation when the driving gear tooth 147 and the gear tooth surfaces 149 and 151 are not in driving engagement with the gear teeth of the first and second sets 155 and 157 of gear teeth, respectively. It is apparent from the foregoing that each revolution of the driving gear 139 imparts a small increment of rotation to the driven gear 141. Solely by way of example, in the illustrated embodiment there is driving engagement between the driving gear 139 and the driven gear 141 for only about 51.4°, and for the remainder of the cycle of rotation of the driving gear 139, the driven gear 141 is held against rotation by the cooperation between the circumferential surface 153 and confronting teeth of the second set of teeth 157. Thus, there is a pause created during each revolution of the driving gear 139. Of course, the driving gear 139** could have additional driving gear teeth and additional gear tooth surfaces, if desired.

Figure 10A:
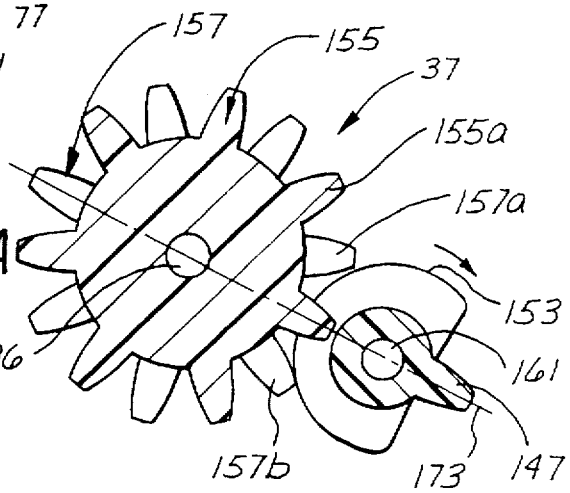
FIG. 10A is a view similar to FIG. 10 showing a portion of the intermittent motion mechanism during a pause in rotation.

Another feature of the intermittent motion mechanism 37 is that it can transmit motion in both the clockwise and counterclockwise directions. Because the driving gear 139 is symmetrical about a reference line 173 (FIG. 10A), and because both of the sets of gear teeth 155 and 157 are similarly symmetrical, the driving gear 139 can drive the driven gear 141 in either direction.

The Adapter Seal

An intermediate wall or transverse member 177 (FIGS. 3, 14 and 15) extends across the riser 15 and is suitably fixed to the riser just above the upper end of the inner housing 72. The adapter seal 39 engages the transverse member 177 immediately below the transverse member. The adapter seal 39 is integrally constructed from a suitable elastomeric material and provides a circular lip seal 179 (FIGS. 12–15) around its circular periphery which forms a seal between the inner periphery of the riser 15 and the outer periphery of the transverse member 177.

It is necessary that several members of the sprinkler 11 protrude through the transverse member 177, and the adapter seal 39 provides seals in each of these instances. Specifically, an output shaft 181 (FIGS. 3, 4A and 14) extends through the transverse member 177 and has a lower gear 183 and an upper gear 185. The lower gear 183 is driven by a pinion 187 (FIG. 4A) integral with a larger gear 189 which is driven by the gear section 159 of the driven gear 141 of the intermittent motion mechanism 37.

The adapter seal 39 has an opening 192 through which the output shaft 181 extends and an annular lip seal 191 (FIG. 14) for sealing around the output shaft. The adapter seal 39 also has annular bosses 193 and 195 (FIGS. 12–14) which are engagable with the transverse member 177 and the inner housing 72, respectively.

The drive train 25 also includes a rotatable drive shaft 197 (FIGS. 3, 14 and 15) which extends through the central openings 199 and 201 of the transverse member 177 and the adapter seal 39, respectively. The drive shaft 197 is rotated by the output shaft 181 as described more fully below. The adapter seal 39 has a central annular projection 203 with an internal lip seal 205 which forms a dynamic seal around the rotatable drive shaft 197. Thus, portions of the drive train 25 are on opposite sides of the transverse member 177 and the adapter seal 39 provides seals between the drive train and the transverse member.

Figure 13A:
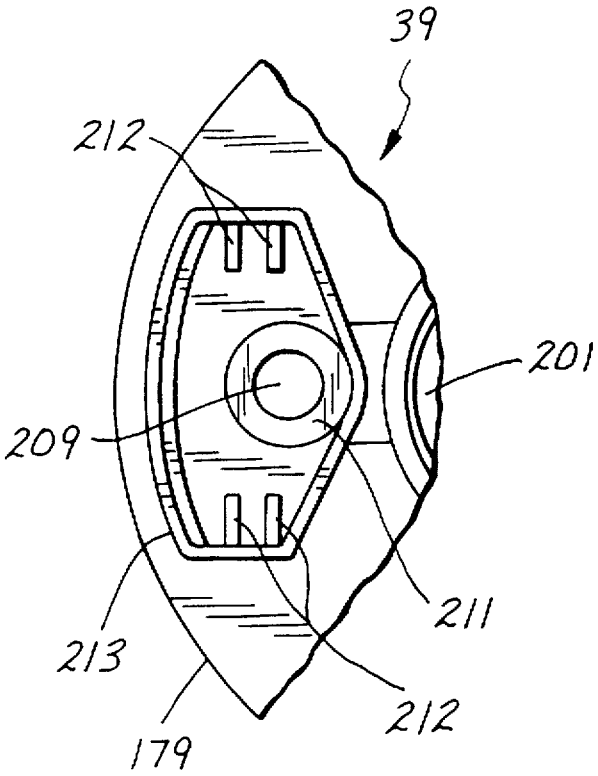
FIG. 13A is a fragmentary bottom plan view of the adapter seal.

A portion of the overcenter spring device 27, namely the input pivot member 103 extends through aligned openings 207 and 209 in the transverse member 177 and the adapter seal 39, respectively. The adapter seal 39 has an integral sealing ridge 211 (FIGS. 13A and 14) which seals between the input pivot member 103 of the overcenter spring device 27 and the transverse member 177. In addition, the adapter seal 39 includes a noncircular, tubular mounting section 213 (FIGS. 13A and 14) for receiving a region of the overcenter spring device 27, namely an upper portion of the retainer 107 to thereby assist in mounting the overcenter spring device in the inner housing 72. The mounting section 213 is itself received within a tubular section 214 (FIG. 14) of the inner housing 72. The mounting section 213 has two pairs of spaced tabs 212 (FIG. 13A) for receiving the upper end portions of the longitudinal members 121 of the retainer 107.

The transverse member 177 includes a projection 215 (FIG. 15) which extends through an opening 217 of the adapter seal and is received in an annular internal mounting wall 219 of the inner housing 72 to thereby assist in mounting the transverse member on the inner housing. The adapter seal 39 has a radial seal 221 which sealingly engages the projection 215 to form a seal to prevent liquid from migrating through the opening 217.

Figure 14:
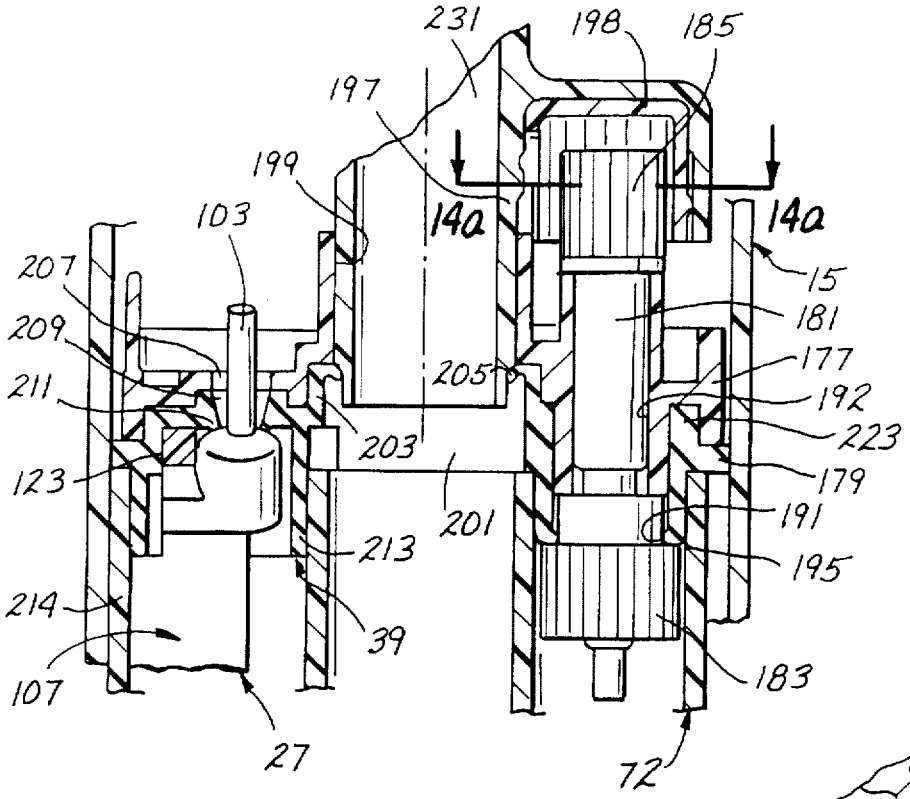
FIG. 14 is an enlarged fragmentary sectional view illustrating a portion of FIG. 3 adjacent the adapter seal on a larger scale.
Figure 15:
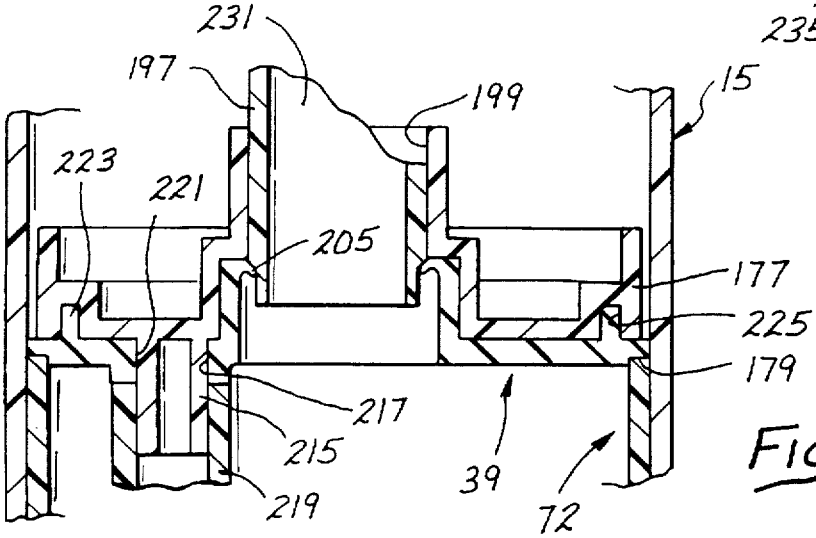

As shown in FIGS. 14 and 15, the upper face of the adapter seal 39 and the lower face of the transverse member 177 are complementary in shape so that these two members are in engagement over much of their confronting surfaces. In addition, the adapter seal 39 has an annular rib 223, which is radially thickened adjacent the opening 209 and which is received in a complementary groove 225 of the transverse member 177.

The adapter seal 39 is a one piece integral member which performs many sealing functions including sealing between the periphery of the transverse member 177 and the riser 15, sealing around the output shaft 181 and the drive shaft 197, sealing around the input member 103 and around the projection 215. In addition, the adapter seal 39 assists in mounting the retainer 107 of the overcenter spring device 27.

From a broader perspective, the adapter seal 39 excludes liquid and particulate contaminants from the components in the riser 15 which are above the adapter seal and outside of a central passage 231 (FIG. 3C) of the drive shaft 197. The lip seal 205 (FIGS. 3C, 14 and 15) seals along a relatively small circumference to thereby reduce the friction tending to retard rotation of the drive shaft. Without the adapter seal 39, it would be necessary to provide a hydraulic seal higher up in the riser 15 at a larger circumference and correspondingly greater friction.

The Sprinkler from the Adapter Seal 39 to the Nozzle 31

Figure 14A:
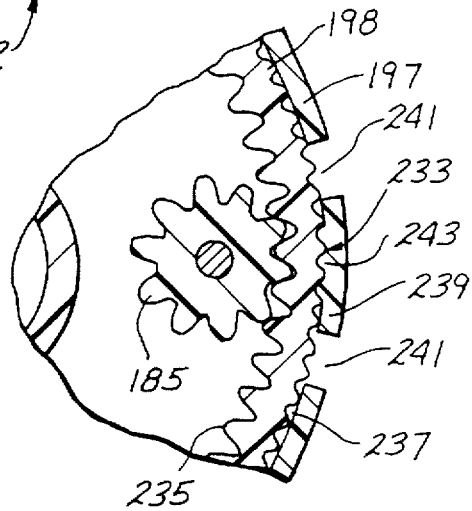
FIG. 14A is a sectional view taken generally along line 14A–14A of FIG. 14.
Figure 16:
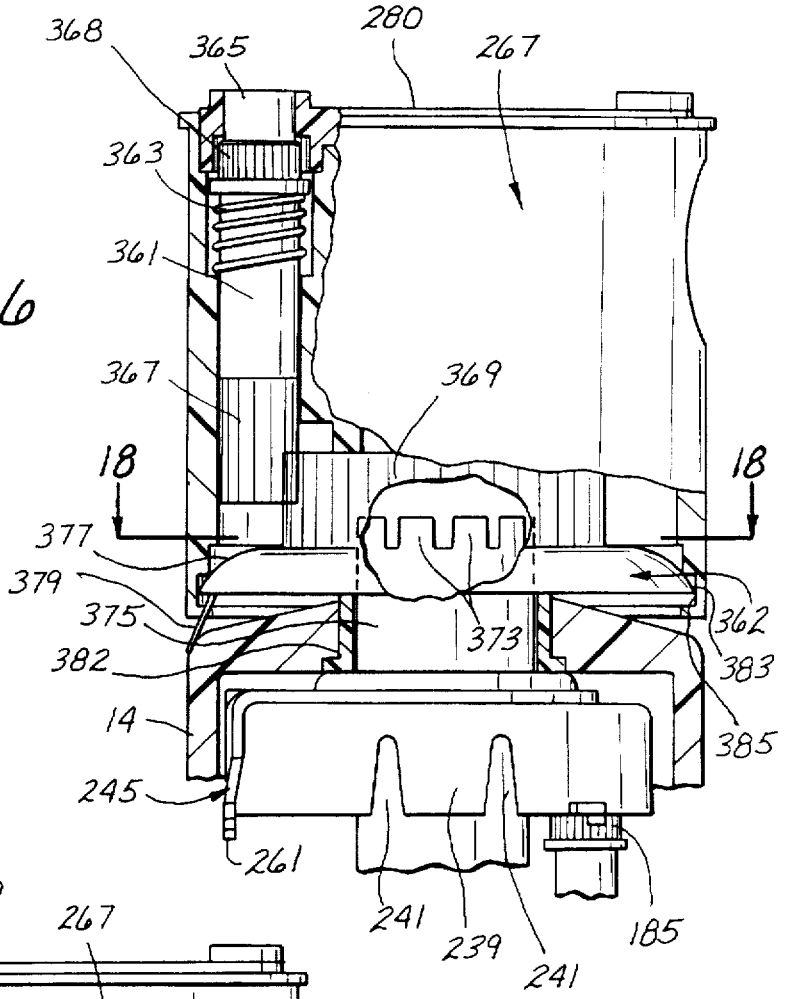
FIGS. 16 and 17 are fragmentary elevational views partially in section of the sprinkler head and portions of the sprinkler immediately below the sprinkler head illustrating how the arc of travel of the sprinkler head can be adjusted.

The gear 185 on the output shaft 181 drives the drive shaft 197 via the drive ring 198 and a clutch 233 (FIG. 14A). More specifically, the gear 185 engages internal gear teeth 235 of the drive ring 198 to rotate the drive ring. The clutch 233 comprises external teeth 237 extending completely around the outer periphery of the drive ring 198, tabs 239 on the drive shaft 197 (only one being shown in FIG. 14A) separated from adjacent lateral regions of the drive shaft by slots 241 (FIG. 16) and internal teeth 243 on the tabs 239 which mesh with the external teeth 237 of the drive ring 198. In this embodiment, there are four of the tabs 239 and they are equally spaced circumferentially. Each of the tabs 239 is somewhat resilient so that in the absence of a strong resisting force, the clutch 233, and more specifically the teeth 237 and 243 transmit rotary motion from the drive ring 198 to the drive shaft 197. However, the gears between the turbine 23 and the output shaft 197 provide sufficient resistance to being back driven so that the tabs 239 can flex radially outwardly to permit the teeth 243 to slide over the teeth 237. As explained more fully below, this is useful in making the sprinkler vandal resistant.

Figure 5:
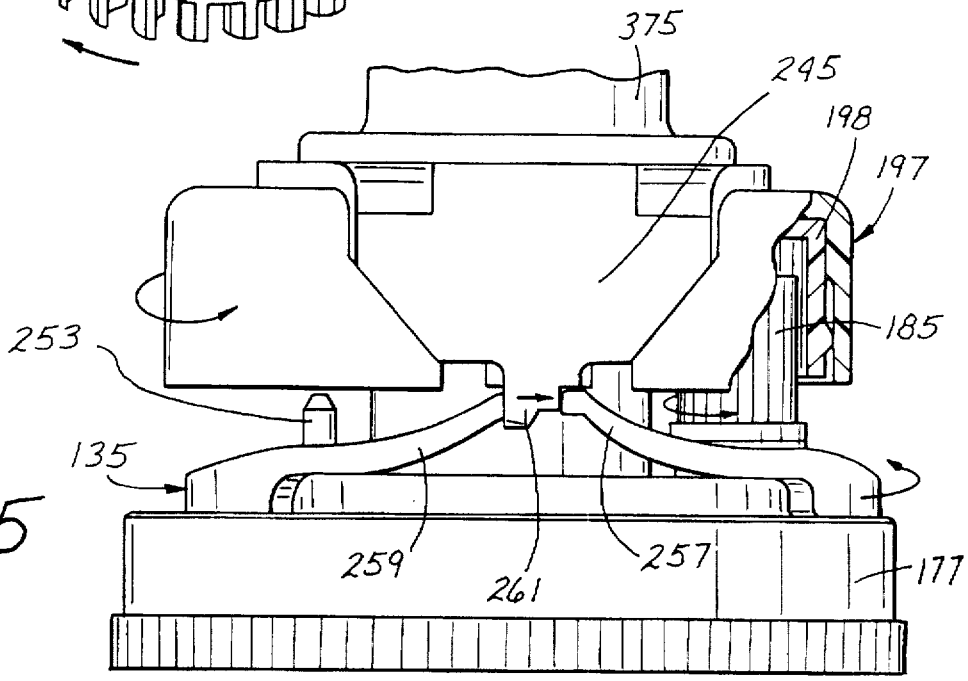
FIG. 5 is a fragmentary elevational view illustrating a preferred way for driving the elongated spring element of FIG. 6 overcenter.
Figure 8:
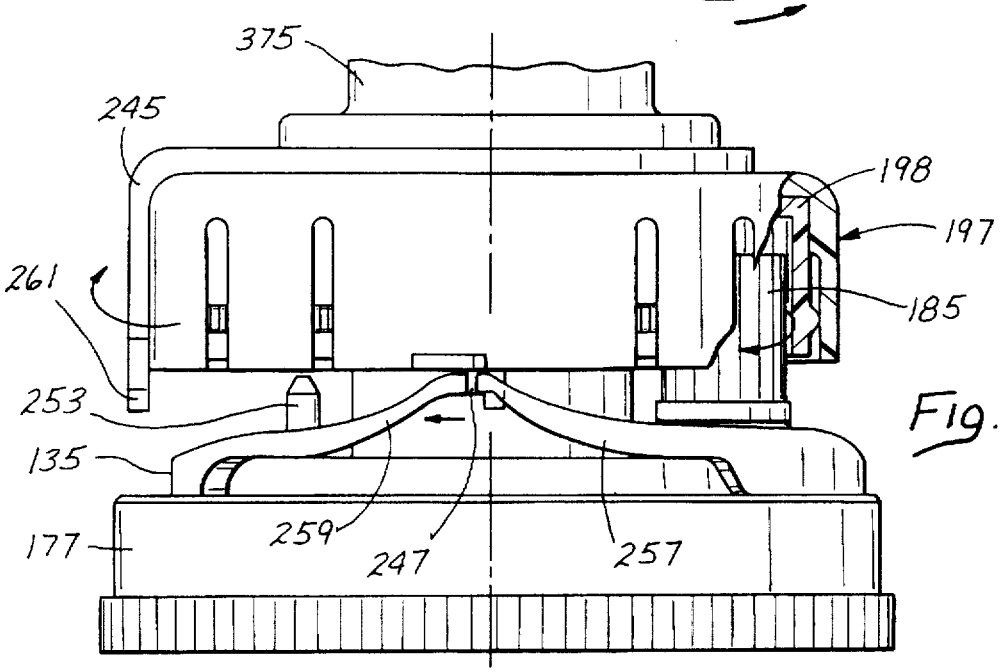
FIG. 8 is a view similar to FIG. 5 illustrating how the elongated spring element can be forced overcenter in the other direction.

The drive shaft 197 provides the passage 231 for water to flow toward the nozzle 31 and its rotary motion drives the nozzle and is also used to provide energy to drive the overcenter spring device 27 over center in both directions. The motion for this latter function is transmitted from the drive shaft 197 to the overcenter spring device 27 by a control ring 245 (FIGS. 3C, 5, 8, 16 and 17), a finger 247 (FIG. 8) on the drive shaft 197 and the rotatable plate 135 (FIGS. 3C, 4–6 and 8). As shown in FIGS. 3C, 5 and 8, the rotatable plate 135 is rotatably mounted on top of the transverse member 177 and is suitably retained by a retainer 249 (FIG. 3C). The extent to which the rotatable plate 135 can rotate is limited as by slots 251 (FIG. 4) through which projections 253 (FIG. 3C) of the transverse member 177 extend.

To enable the rotation of the rotatable plate 135 to drive the overcenter spring device 27 overcenter to accomplish reversal in the direction of rotation of the sprinkler head 29, the rotatable plate has a narrow opening 255 through which the input pivot member 103 extends (FIGS. 4 and 6A). Normally, the rotatable plate 135 is held against rotation by the input pivot member 103 which is in one of its two bistable positions. However, the rotatable plate 135 has two flexible, resilient arms 257 and 259 (FIGS. 5 and 8) with radially offset ends which are engagable with a projection 261 (FIG. 5) on the control ring 245 and the finger 247 (FIG. 8) on the drive shaft 197, respectively, such that the rotatable plate can be driven in opposite directions.

By way of example, the rotatable plate 135 may rotate 40 degrees in each direction, i.e. plus or minus 20 degrees on either side of a neutral position (FIG. 6B) of the spring 101. This defines the circumferential zone of operation of the rotatable plate 135 and the arms 257 and 259.

More specifically, rotation of the drive shaft 197 rotates the sprinkler head 29 which in turn rotates the control ring 245 as described more fully below (FIG. 3C). Consequently, sufficient counterclockwise rotation of the drive shaft 197 and the control ring 245 causes the projection 261 to contact the arm 257 as shown in FIG. 5 to initiate rotation of the rotatable plate 135 thereby driving the input pivot member 103 and moving the overcenter spring device 27 over center. This overcenter movement of the overcenter spring device 27 reverses the direction of rotation of the gears and hence of the drive shaft 197 whereupon the drive shaft rotates in a clockwise direction. This clockwise rotation continues until eventually the finger 247 (FIG. 8) is brought into engagement with the end of the arm 259 of the rotatable plate 135 to thereby drive the plate in the opposite direction and move the overcenter spring device 27 overcenter. This causes reversal of the direction of rotation of the gears and of the drive shaft 197 whereupon the operation described above is repeated. Because the ends of the arms 257 and 259 as well as the finger 247 and the projection 261 are radially offset, the finger 247 will not drivingly contact the arm 257 and the projection 261 will not drivingly contact the end of the arm 259.

The drive shaft 197 also drives the sprinkler head or spray head 29. The spray head 29, which may be considered as part of the riser 15 includes a sprinkler head housing 267 (FIG. 3C) and the housing 267 provides an annular inner wall or socket 269 for receiving an upper end of the drive shaft 197 to mount the spray head 29 for rotation with the drive shaft. The upper end of the drive shaft 197 in this embodiment is snap fit into a separate bushing 271 which is received within and bonded to the socket 269. Consequently rotation of the drive shaft 197 rotates the spray head 29 so the spray head 29 oscillates or rotates in both directions with the drive shaft 197.

The Spray Head 29 and the Nozzle 31

The sprinkler head housing 267 in this embodiment comprises a body 277 molded from a suitable polymeric material, an inner cap 279 (FIG. 3C) of a rigid polymeric material and an outer cap 280 (FIG. 24) of a suitable elastomeric material closing the upper end of the body. The outer cap 280 is not shown in FIGS. 3, 3C, 16 and 17. The spray head 29 includes the nozzle 31 (FIGS. 3, 3C and 19–21) and the sprinkler head housing 267 which includes nozzle mounting structure for mounting the nozzle on the sprinkler head housing 267. More specifically, the nozzle mounting structure includes a circumferential wall 281 defining a bore 283 and a supply passage 285 for conveying water under pressure from the passage 231 through the drive shaft 197 to the bore 283 and to the nozzle 31. In the form shown in FIG. 3C, the nozzle mounting structure is an integral portion of the sprinkler head housing 267. The nozzle 31 is received in the bore 283 so it can receive water under pressure from the supply passage 285.

Figure 19:
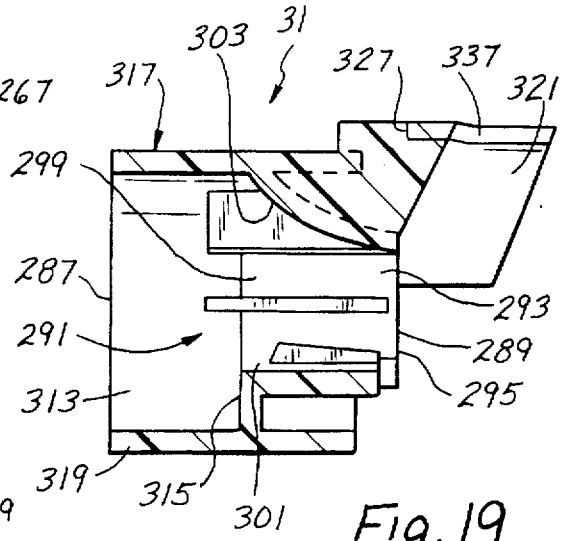
FIG. 19 is a longitudinal sectional view through a preferred form of nozzle.
Figure 20:
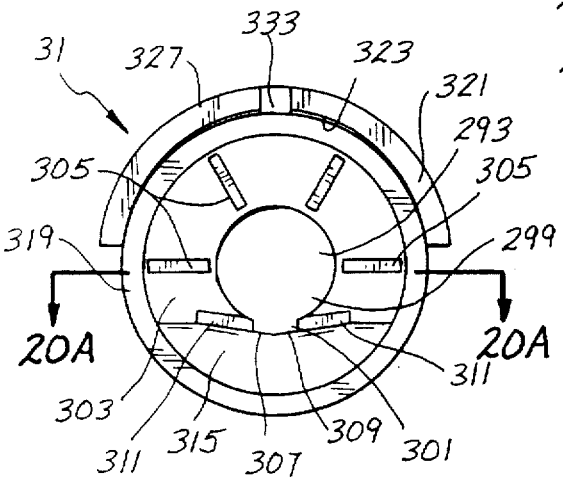
FIGS. 20 and 21 are rear and front elevational views, respectively, of the nozzle.
Figure 20A:
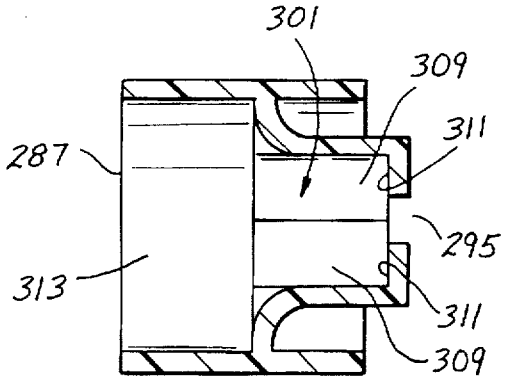
FIG. 20A is a sectional view taken generally along line 20A–20A of FIG. 20.
Figure 21:
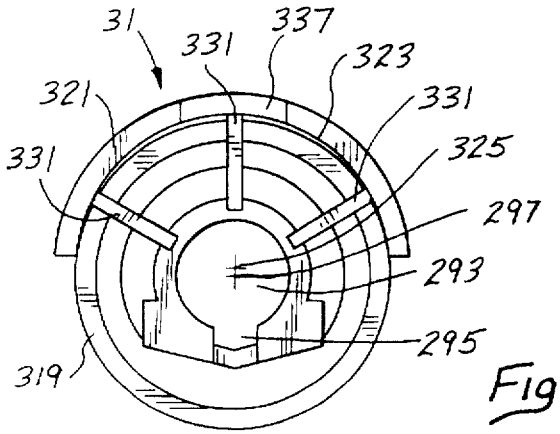

With reference to FIGS. 19-21, the nozzle 31 has an inlet 287, an outlet 289 and a flow passage 291 extending between the inlet and the outlet. The outlet 289 has a far stream portion 293 and a near stream portion 295, and as shown in FIG. 21, the outlet is unpartitioned, i.e. has no partitions, between the far stream and near stream portions so that a single stream can be emitted from the outlet. The far stream portion 293 has a center 297, and in this embodiment, the far stream portion of the outlet is generally circular about the center 297. The near stream portion 295 of the outlet 289 is generally rectangular and of smaller cross section than the far stream portion 293 and together with the far stream portion 293 forms a somewhat keyhole-shaped outlet.

The flow passage 291 also has a far stream portion 299 and a near stream portion 301 leading to the far stream portion 293 and near stream portion 295, respectively of the outlet 289. The flow passage 291 is also unpartitioned between its far stream portion 299 and its near stream portion 301.

The far stream portion 299 and the near stream portion 301 of the flow passage 291 are configured to provide higher velocity less turbulent flow through the far stream portion 293 of the outlet 298 than through the near stream portion 295 of the outlet 289. Consequently, the stream emitted from the far stream portion 293 retains a more rod-like configuration and travels farther than the water emitted from the near stream portion 295.

Although this result may be obtained in different ways, in the illustrated embodiment, the far stream portion 299 of the flow passage 291 converges toward the center 297 of the far stream portion 293 of the outlet 289 as it extends toward the outlet and the near stream portion 301 of the flow passage is less convergent toward the center 297 of the far stream portion 299 of the outlet as it extends toward the outlet than the far stream portion 299 of the flow passage. Consequently, the far stream portion 299 of the flow passage 291 provides a portion of the stream which can travel farther than the portion of the stream which is provided by the near stream portion 301 of the flow passage.

More specifically, the far stream portion 299 of the flow passage 291 has a smooth curved surface 303 which is part annular and which extends almost completely around the far stream portion 299 of the flow passage. The nozzle 31 includes radially extending vanes 305 (four being shown in FIG. 20) on the curved surface 303 for directing water toward the far stream portion 293 of the outlet 289. In this embodiment, the vanes 305 extend axially and radially and are circumferentially spaced.

The curved surface 303 converges toward the far stream portion 293 of the outlet 289 such that the far stream portion 293 forms, in effect, the throat of a nozzle.

Consequently, the water flowing toward the far stream portion 293 of the outlet 289 is crowded together to increase the velocity head of the stream with reduced turbulence to provide a stream portion which will travel relatively far.

The near stream portion 301 of the flow passage 291 has a longitudinal, generally trough-shaped surface 307 which extends toward the near stream portion 295 of the outlet 289 and which is essentially non-inclined radially inwardly as it extends toward such near stream portion of the outlet. The trough-shaped surface 307 includes substantially flat surfaces 309 which meet at an apex to form a shallow V or shallow trough. The flat surfaces 309 extend longitudinally toward the near stream portion 295 of the outlet 289. It can be seen therefore that the near stream portion 301 of the flow passage 291 is less convergent toward the center 297 of the far stream portion 293 of the outlet 289 as it extends toward the outlet than the far stream portion 299 of the flow passage.

The near stream portion 301 of the flow passage 291 preferably has one or more ledges 311 adjacent the outlet 289 which narrows the near stream portion 301 of -the flow passage and provides water for intermediate distances. In this embodiment, there are two of such i ledges 311 on opposite sides of the near stream portion 301 of the flow passage 291. The ledges 311 narrow the near stream portion 301 of the flow passage 291 and assist in providing some water for intermediate distances.

The nozzle 31 has an inlet section 313 of larger cross sectional area than the combined cross sectional areas of the far stream portion 299 and the near stream portion 301 of the flow passage 291. The inlet section 313 is upstream of the far stream portion 299 and the near stream portion 301 of the flow passage 291. The flow passage 291 has a turbulence creating surface between the inlet section 313 and the near stream portion 301 of the flow passage 291 for causing turbulence in the water flowing from the inlet section to the near stream portion 301 of the flow passage. Preferably, the turbulence creating surface includes a ledge 315 facing the inlet 287.

The nozzle 31 has a peripheral wall 317 which includes a main body 319 and a hood 321 which is radially offset from the main body to form an opening 323. In this embodiment, the main body 319 is generally cylindrical about the center 297 and the hood 321 includes a generally cylindrical section having a center 325 which is radially offset from the center 297 as shown in FIG. 21. The hood provides an abutment 327 for engagement by a tool 329 (FIGS. 22 and 23) as described more fully below for withdrawing the nozzle 31 from the bore 283. The opening 323 allows the tool 329 to gain access to the abutment 327 for this purpose.

The nozzle 31 includes vanes 331 (three being shown in FIG. 21) between the hood 321 and the main body 319 for strengthening purposes and for directing water from the opening 323 as described more fully hereinbelow. The central vane 331 includes a rib 333 which extends between the main body 319 and the hood 321 and across the opening 323 to bifurcate the opening.

The nozzle 31 is received in the bore 283 as shown in FIGS. 3 and 3A. To retain the nozzle 31 in the bore 283, a threaded fastener in the form of a screw 335 extends through an upper region of the sprinkler head housing 267 and through a groove 337 (FIGS. 3C, 19 and 21) of the hood 321. Thus, the main body 319 and the hood 321 are received in the bore 283 so that the nozzle 31 can receive water under pressure from the supply passage 285 so water can pass through the flow passage 291 and outlet 289 to form a stream. The pressure of the water from the supply passage 285 acting on the nozzle 31 tends to pivot or tilt the nozzle in the bore 283 about an axis which is generally transverse to the flow passage 291. More specifically, the screw 335 forms a fulcrum about which the nozzle 31 tends to pivot. The nozzle 31 tends to pivot clockwise as viewed in the FIG. 3C about the fulcrum formed by the screw 335. This tendency to pivot tends to separate regions of the peripheral wall 317 and the circumferential wall 281 to form a leakage path 339 (FIGS. 3 and 3C) which leads to the opening 323. The leakage path directs any such leakage toward the stream emanating from the outlet 289 downstream of the outlet 289. Thus, any such leakage can form a part of the stream emitted from the outlet 289.

It should be understood that the so-called leakage path 339 may or may not exist depending on various factors such as temperature, tolerances, warping of the nozzle or the bore 283, etc. and is greatly exaggerated in FIG. 3C. Thus the leakage path may be a tight interface through which no water passes. However, this feature of the invention recognizes that in some circumstances there will be some leakage passing through the path 339 and provides for return of this water to the flow stream from the outlet such that the leakage is not uncontrolled.

It should also be noted that the radial offset of the hood 321 and the peripheral wall 317 provides an advantageous way to create the opening 323 for the leakage path 339. Also, the vanes 331 tend to direct any leakage from the opening 323 to the stream from the outlet 289.

With this construction, the sprinkler head 267 and the nozzle 31 are driven back and forth through an arc of predetermined length. During this time, water flows from the passage 231 (FIG. 3C) through the supply passage 285, the flow passage 291 of the nozzle 31 and the outlet 289 of the nozzle. The water flowing through the far stream portion 299 of the flow passage 291 is caused to converge by the curved surface 303 and to accelerate through the far stream portion 293 of the outlet 289 to form the far stream portion of the stream, i.e. the portion of the stream that will travel a relatively great distance from the sprinkler 11. On the other hand, water striking the ledge 315 is made relatively turbulent and the water passing through the near stream portion 301 of the flow passage 291 is restricted or converged much less than the water flowing through the far stream portion 299. Consequently the water forming the near stream portion has reduced velocity energy and this causes this portion of the stream to fall off more quickly to water regions nearer to the sprinkler 11. Any leakage through the path 283 passes through the opening 323 and rejoins the stream emanating from the outlet 289.

Figure 22:
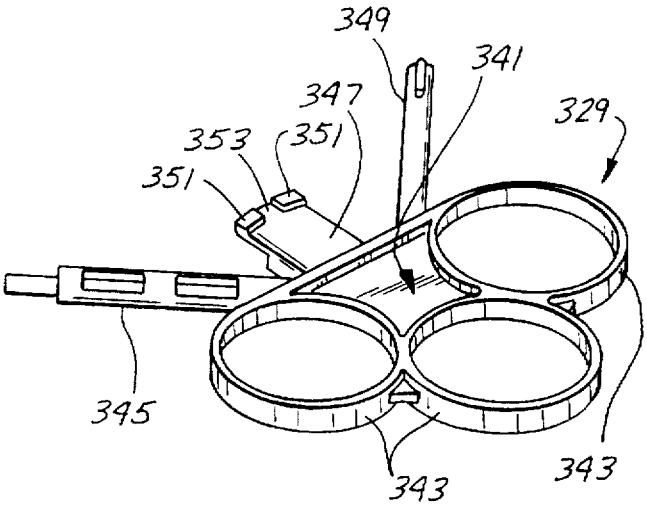
FIG. 22 is a perspective view of a preferred tool for use in removing the nozzle from the sprinkler head.

Another feature of the invention is that the nozzle 31 can be easily removed from the sprinkler head housing 267 utilizing the tool 329 without damage to the critical nozzle surfaces. As shown in FIG. 22, the tool 329 comprises a body 341 having three finger rings 343 and three elongated arms 345, 347 and 349 projecting from the body 341. The central arm 347 has two tabs 351 separated by a gap 353.

Figure 23:
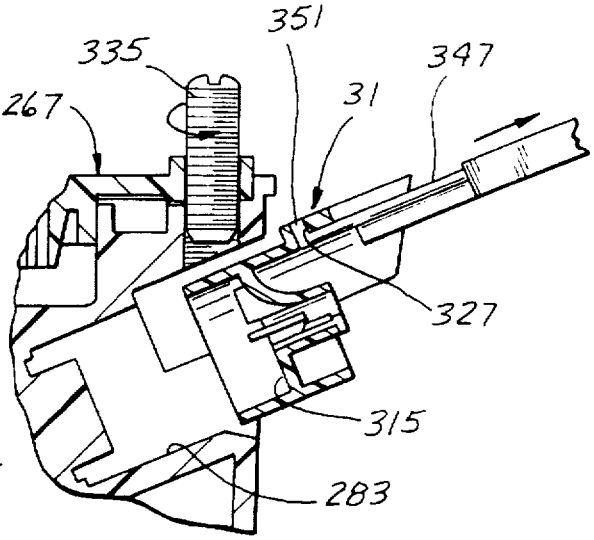
FIG. 23 is a fragmentary sectional view showing use of the tool to remove the nozzle from the sprinkler head.

To remove the nozzle 31 from the sprinkler head housing 267, the screw 335 is removed sufficiently so that it does not impede withdrawal of the nozzle 31 from the bore 283. The leg 347 is inserted into the hood 321 as shown in FIG. 23 with the tabs 351 being received in the opening 323 on opposite sides of the rib 333 of the central vane 331 such that the tabs engage the abutment 327. The nozzle 31 can then be removed by an outwardly directed force as shown in FIG. 23. The arms 345 and 349 are not needed for nozzle withdrawal feature, but can be provided for other purposes, if desired.

The Arc Setting

To establish a zero point for adjusting the arc through which the sprinkler head 29 moves, the sprinkler 11 has a marker 359 (FIG. 24) on the exterior of the riser 15 which is axially aligned with the confronting ends of the arms 257 and 259 (FIGS. 4, 5, 8 and 24) of the rotatable plate 135. Arc adjustment is accomplished by rotating the control ring 245 (FIGS. 5, 8, 16, 17 and 24) with respect to the finger 247 (FIGS. 8 and 24) and the ends of the arms 257 and 259 or with respect to the marker 359 which marks the location of the ends of these arms.

Figure 24:
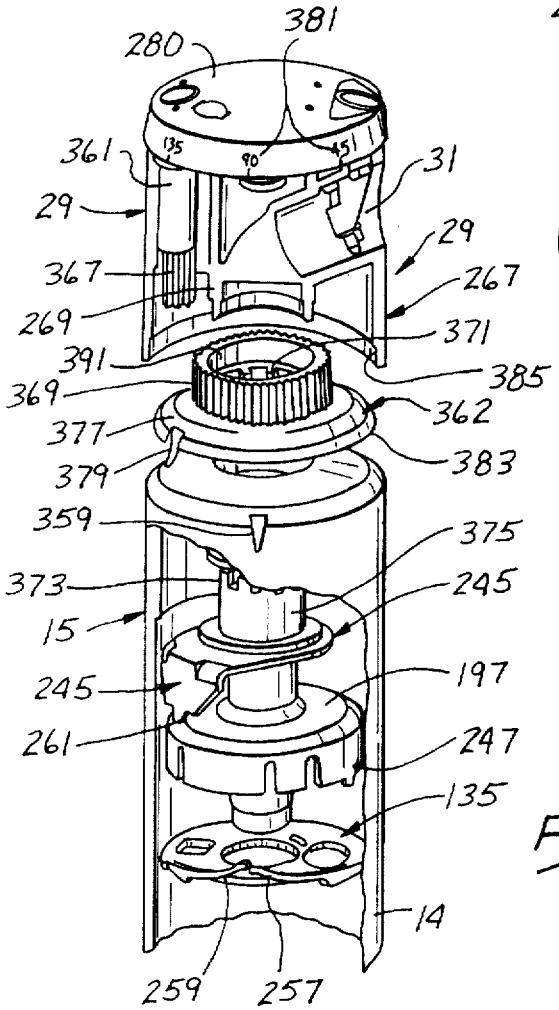
FIG. 24 is a simplified, fragmentary, exploded, perspective view of an upper portion of the sprinkler with the sprinkler head rotated relative to the portions of the sprinkler below the sprinkler head.

The sprinkler 11 has an arc controller for controlling the magnitude of the arc through which the sprinkler head can rotate. The arc controller includes the finger 247 (FIGS. 8 and 24), the projection 261 (FIGS. 5 and 24) and the arms 257 and 259 (FIGS. 5, 8 and 24). The sprinkler 11 also includes an arc adjuster for adjusting the arc controller to thereby adjust the arc through which the sprinkler head 29 can rotate. This adjustment to the arc controller adjusts the circumferential spacing between the finger 247 and the -projection 261.

Figure 17:
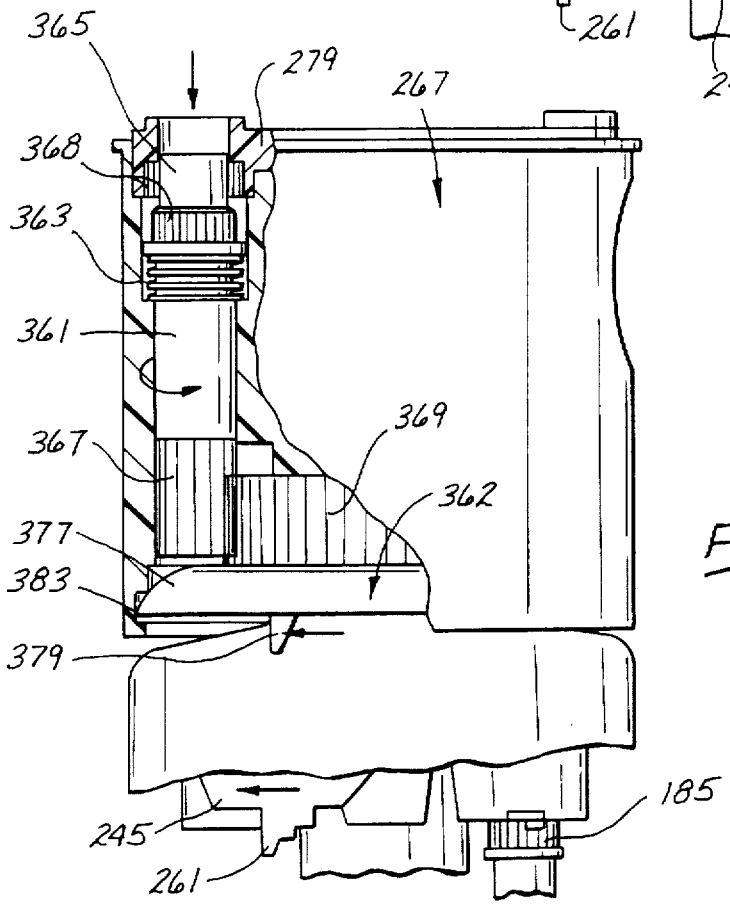

The arc adjuster includes an arc adjust driver in -the form of an arc adjust stem or arc adjusting stem 361 (FIGS. 3, 3C, 16, 17 and 24), an arc adjust member 362 and the control ring 245 (FIGS. 5, 8, 16, 17 and 24) which carries the projection 261. The arc adjusting stem 361 (FIG. 16 and 17) is rotatably mounted in the sprinkler head housing 267 and is biased upwardly by a coil compression spring 363. The arc adjusting stem 361 has a head 365 at its upper end with a socket 366 (FIG. 3C) to receive an appropriate tool and a pinion 367 at its lower end. Locking splines 368 (FIG. 16) on the stem 361 and the outer cap 280 allow the stem 361 to be moved axially between an upper position of FIG. 16 and a lower position of FIG. 17. The splines 368 hold the stem against rotational movement when the stem is in its upper position (FIG. 16) and allow the stem 361 to be rotated in the lower position (FIG. 17).

The pinion 367 meshes with a gear section or arc adjusting gear 369 of the arc adjust member 362. The arc adjust member 362 is mounted for rotational movement with the sprinkler head 29 as described more fully below. The arc adjust member 362 has a series of radially inwardly extending internal teeth or projections 371 (FIGS. 18 and 24) which mesh with mating teeth 373 on an upwardly extending stem 375 (FIGS. 16, 18 and 24) of the control ring 245 thereby drivingly coupling the arc adjust member 362 to the projection 261 and enabling rotation of the arc adjust member 362 relative to the sprinkler head 29. Consequently, rotation of the pinion 367 rotates the control ring 245 and the projection 261 on the control ring to thereby change the circumferential spacing between the projection 261 and the arm 257 and between the projection 261 and the finger 247. This circumferential spacing defines the arc through which the sprinkler head 29 will rotate.

Figure 18:
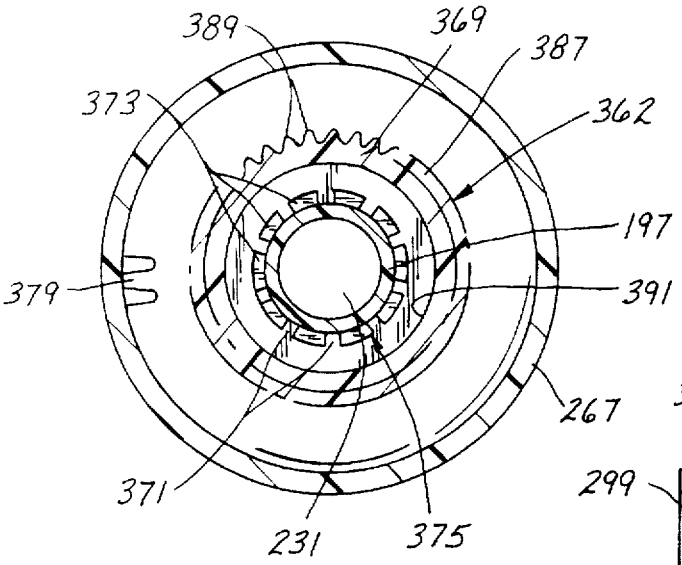
FIG. 18 is a sectional view taken generally along line 18–18 of FIG. 16.

In operation, rotation of the drive shaft 197 rotates the sprinkler head 29 through the bushing 271 and the socket 269 (FIG. 3C). As the sprinkler head 29 rotates in one direction, it either advances the projection 261 toward the associated arm 257 or the finger 247 toward the associated arm 259. More specifically rotation of the sprinkler head 29 with the pinion 367 of the arc adjusting stem 361 meshing with the arc adjusting gear 369 causes rotation of the arc adjusting gear 369 with the sprinkler head 29 and consequent rotation of the control ring 245 by virtue of the engagement of the teeth 371 and 373 (FIG. 18). Consequently, the control ring 245 and its projection 261 rotate with the sprinkler head 29. Because the finger 247 is on the drive shaft 197, it also rotates with the drive shaft and with the sprinkler head. Because both the projection 261 and the finger 247 move with the sprinkler head 229, they can be used to reverse the direction of movement of the sprinkler head and to establish the arc through which the sprinkler head 29 rotates.

Assuming, for example, that the direction of rotation of the sprinkler head 29 is such as to move the projection 261 toward the arm 257, eventually the projection will contact the arm as shown in FIG. 5 and thereby rotate the rotatable plate 135 to move the input pivot member 103 to move the overcenter spring device 27 overcenter as described above in connection with FIGS. 6–A6C. This brings about reversal of the direction of rotation of the drive shaft 197 as also described above whereupon the sprinkler head 29 reverses its direction of rotation to move the finger 247 toward the arm 259. When the finger 247 contacts the arm 259 as shown in FIG. 8, it counterrotates the rotatable plate 135 to move the overcenter device 27 overcenter in the opposite direction to again reverse the direction of rotation.

The arc adjusting member 362 has a wall or annular flange 377 (FIG. 3C, 16, 17 and 24) with a projection forming a pointer 379 which is visible from outside the sprinkler 11 between the sprinkler head housing 267 and the portions of the housing 14 of the riser 15. As best seen in FIGS. 17 and 24, the pointer 379 is in axial alignment with the projection 261 such that the pointer can indicate the circumferential location of the projection 261. Also, the marker 359 (FIG. 24) is in axial alignment with the confronting ends of the arms 257 and 259 (FIGS. 4, 5, 8 and 24). Consequently, the locations of the projection 261 and the confronting ends of the arms 257 and 259 are known from the exterior of the sprinkler 11, and the marker 359 and pointer 379 visually indicate the locations of the opposite ends of the arc through which the sprinkler head 29 can rotate.

Preferably, the sprinkler head 29 is supplied by the manufacturer with the nozzle 31 in approximately axial alignment with the marker 359. To install the sprinkler 11 with the desired arc of rotation, the sprinkler is positioned with the marker 359 aimed at the right edge of the arc, e.g. at 3 o'clock. Using an appropriate tool, such as the arm 345 of the tool 329, the arc adjusting stem 361 is depressed to the position of FIG. 17 to unlock the locking splines 368 and then rotated to rotate the arc adjust member 362, the pointer 379 of the arc adjust member and the projection 261 relative to the sprinkler head 29 to a desired location to establish the other edge of the arc. The angular magnitude of the arc can be ascertained by the pointer 379 and indicia 381 (FIG. 24) on the outer cap 280 of the sprinkler head 29. Specifically the magnitude of the arc is indicated by the number of the indicia 381 which is in axial alignment with the pointer 379. In this manner, the arc of rotation is determined and oriented with respect to the surface to be irrigated. The arc of watering can be adjusted from a very small arc roughly equal to the arc size required for reversing rotation of the sprinkler head 29 to 360° or more. The finger 247 is circumferentially offset from the nozzle 31 an amount which defines the minimum arc of rotation of the sprinkler head 29.

The sprinkler 11 also has a vandal resistant feature in that any turning of the sprinkler head 29 beyond the preset arc results in slippage of the clutch 233 (FIG. 14A) to thereby protect the gear train against damage. The arms 257 and 259 (FIG. 4) are sufficiently flexible in the axial and radial directions to permit them to be forcibly biased by the projection 261 and the finger 247 so that the projection and finger can ride over these arms if a sufficient force, which greatly exceeds normal operating forces, is applied. Manual rotation of the sprinkler head 29, such as by a vandal, may also direct the nozzle 31 outside of the desired watering arc. In addition the arms 257 and 259 do not move outside their circumferential zone of operation, e.g. plus or minus 20°, and so the sprinkler will self-correct and automatically return to the desired watering arc thereby providing a memory arc feature.

The arc adjust member 362 also provides a plurality of seals which exclude grit from a bearing 382 (FIG. 3C) which circumscribes the drive shaft 197 adjacent the sprinkler head 29 and which forms a portion of the supporting structure for the sprinkler 11. For example, the flange 377 terminates radially outwardly in a static seal 383 (FIGS. 3C, 16 and 17) which is integral with the arc adjust member and which sealingly engages an inner annular surface 385 of the sprinkler head housing 267. In addition, the gear section 369 includes an annular wall 387 (FIG. 18) having external gear teeth 389 (FIG. 18) and an internal surface 391 (FIGS. 3C and 18) sealingly receiving the upper end of the inner wall or socket 269 of the housing 267 of the sprinkler head 29 to thereby provide a second static seal integral with the arc adjust member 362. The internal wall 391 receives the inner wall 269 so as to allow these walls to slide relative to each other for arc adjustment but snugly enough to serve as a grit seal.

The arc adjust member 362 also includes an annular dynamic seal 393 (FIG. 3C) depending from the wall or flange 377 and sealingly engaging the bearing 382. The seal 393 rotates with the sprinkler head and the bearing 382 is stationary and so the seal 393 is a dynamic seal.

The arc adjust member 362 is preferably a one-piece member and can advantageously be integrally molded of a polymeric material. At least radial outer portions of the flange 377 are preferably resiliently flexible so that the seal 383 is resiliently biased against the inner surface 385. The seals 383 and 393 and the static seal provided by the internal surface 391 exclude grit from the three possible grit paths which lead to the bearing 382.

Although an exemplary embodiment of the invention has been shown and described, many changes, modifications and substitutions may be made by one having ordinary skill in the art without necessarily departing from the spirit and scope of this invention.

We claim:

1. A rotary sprinkler comprising:

a supporting structure having an inlet for receiving irrigation water;

a sprinkler head mounted for rotational movement on the supporting structure and adapted to receive irrigation water from the inlet;

a drive motor carried by the supporting structure;

a drive train having a rotational output and being drivingly coupled to the motor and to the sprinkler head so that the rotational output can impart rotational movement to the sprinkler head;

said drive train including an intermittent motion mechanism for causing a pause in said rotational output whereby the sprinkler head is rotated intermittently; and said intermittent motion mechanism including a driving gear and a driven gear, said driving and driven gears having gear tooth surfaces which are engageable to cause the driving gear to drive the driven gear and disengageable to enable creation of said pause.

2. A rotary sprinkler as defined in claim 1 including a shifter for reversing the direction of said rotational output and said intermittent motion mechanism causes a pause in said rotational output in each direction of said rotational output.

3. A rotary sprinkler as defined in claim 1 wherein the rotational output can be in either direction and said intermittent motion mechanism causes a pause in said rotational output in each direction of said rotational output.

4. A rotary sprinkler comprising:

a supporting structure having an inlet for receiving irrigation water;

a sprinkler head mounted for rotational movement on the supporting structure and adapted to receive irrigation water from the inlet;

a drive motor carried by the supporting structure;

a drive train having a rotational output and being drivingly coupled to the motor and to the sprinkler head so that the rotational output can impart rotational movement to the sprinkler head;

said drive train including an intermittent motion mechanism for causing a pause in said rotational output whereby the sprinkler head is rotated intermittently;

said intermittent motion mechanism including a driving gear having a driving gear tooth on one level and first and second circumferentially spaced gear tooth surfaces on a second level, said driving gear tooth being between said gear tooth surfaces and axially offset from said gear tooth surfaces;

said intermittent motion mechanism including a driven gear having a first set of gear teeth on one level and a second set of gear teeth on a second level, the gear teeth of the first set being axially and circumferentially offset from the gear teeth of the second set;

the driving gear tooth being drivingly engageable with the gear teeth of the first set and the gear tooth surfaces being drivingly engageable with the gear teeth of the second set to drive the driven gear, said driving gear having a circumferential surface axially offset from said driving gear tooth and cooperable with the gear teeth of the second set to substantially retain the driven gear against rotation when said driving gear tooth and said gear tooth surfaces are not in driving engagement with the gear teeth of the first and second sets of gear teeth, respectively; and adjacent gear teeth of each of said first and second sets being spaced circumferentially by an amount sufficient to accommodate another gear tooth and two tooth spaces with said another gear tooth and said tooth spaces being of a size to cooperate with said driving gear tooth.

5. A rotary sprinkler as defined in claim 4 including a shifter for reversing the direction of said rotational output and said intermittent motion mechanism causes a pause in said rotational output in each direction of said rotational output.

6. A rotary sprinkler as defined in claim 4 wherein the first and second gear tooth surfaces drive the driven gear in opposite directions, respectively.

7. A rotary sprinkler comprising:

a supporting structure having an inlet for receiving irrigation water;

a sprinkler head mounted for rotational movement on the supporting structure and adapted to receive irrigation water from the inlet;

a drive motor carried by the supporting structure;

a drive train having a rotational output and being drivingly coupled to the motor and to the sprinkler head so that the rotational output can impart rotational movement to the sprinkler head;

said drive train including an intermittent motion mechanism for causing a pause in said rotational output whereby the sprinkler head is rotated intermittently; and said intermittent motion mechanism including a multilated tooth intermittent drive capable of being driven and of transmitting motion in clockwise and counterclockwise directions.

8. A rotary sprinkler comprising:

a supporting structure having an inlet for receiving irrigation water;

a sprinkler head mounted for rotational movement on the supporting structure and adapted to receive irrigation water from the inlet;

a drive motor carried by the supporting structure;

a drive train having a rotational output and being drivingly coupled to the motor and to the sprinkler head so that the rotational output can impart rotational movement to the sprinkler head;

said drive train including an intermittent motion mechanism for causing a pause in said rotational output whereby the sprinkler head is rotated intermittently;

said intermittent motion mechanism including a driving gear and a driven gear, said driving gear driving said driven gear intermittently to create said pause; and said driven gear having a first set of gear teeth on one level and a second set of gear teeth on a second level, the gear teeth of the first set being axially and circumferentially offset from the gear teeth of the second set.

9. A rotary sprinkler as defined in claim 8 wherein the driving gear has a driving gear tooth drivingly engageable with the gear teeth of the first set to drive the driven gear and a circumferential surface, axially offset from said driving gear tooth and cooperable with the gear teeth of the second set to substantially retain the driven gear against rotation.

10. A rotary sprinkler as defined in claim 9 wherein adjacent gear teeth of each of said first and second sets are spaced circumferentially by an amount sufficient to accommodate another gear tooth and two tooth spaces with said another gear tooth and said tooth spaces being of a size to cooperate with said driving gear tooth.

11. A rotary sprinkler as defined in claim 8 wherein the driving gear has a single driving gear tooth on one level which is drivingly engageable with the first set of gear teeth and a gear tooth surface on a second level which is drivingly engageable with the second set of gear teeth.

12. A rotary sprinkler comprising:

a supporting structure having an inlet for receiving irrigation water;

a sprinkler head mounted for rotational movement on the supporting structure and adapted to receive irrigation water from the inlet;

a drive motor carried by the supporting structure;

a drive train having a rotational output and being drivingly coupled to the motor and to the sprinkler head so that the rotational output can impart rotational movement to the sprinkler head;

said drive train including an intermittent motion mechanism for causing a pause in said rotational output whereby the sprinkler head is rotated intermittently;

said intermittent motion mechanism including a driving gear and a driven gear and said driving and driven gears being drivingly engageable; and said driven gear having a first set of gear teeth on one level and a second set of gear teeth on a second level, the gear teeth of the first set being axially and circumferentially offset from the gear teeth of the second set, adjacent gear teeth of each of said first and second sets being spaced circumferentially by an amount sufficient to accommodate another gear tooth and two tooth spaces with said another gear tooth and said tooth spaces being of a size to cooperate with said driving gear.

13. A rotary sprinkler comprising:

a supporting structure having an inlet for receiving irrigation water;

a sprinkler head mounted for rotational movement on the supporting structure and adapted to receive irrigation water from the inlet;

a drive motor carried by the supporting structure;

a drive train having a rotational output and being drivingly coupled to the motor and to the sprinkler head so that the rotational output can impart rotational movement to the sprinkler head;

said drive train including an intermittent motion mechanism for causing a pause in said rotational output whereby the sprinkler head is rotated intermittently;

said intermittent motion mechanism including a driving gear and a driven gear and said driving and driven gears being drivingly engageable; and the driving gear having a driving gear tooth on one level and first and second circumferentially spaced gear tooth surfaces on a second level, said driving gear tooth being between said gear tooth surfaces and axially offset from said gear tooth surfaces and the driven gear being cooperable with the driving gear tooth and said first gear tooth surface to be driven in one direction and with the driving gear tooth and said second gear tooth surface to be driven in the other direction.

* * * * *